US006699653B2

(12) United States Patent
Goto

(10) Patent No.: US 6,699,653 B2
(45) Date of Patent: Mar. 2, 2004

(54) PHOTOTHERMOGRAPHIC MATERIAL

(75) Inventor: Takahiro Goto, Minami-ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/209,895

(22) Filed: Aug. 2, 2002

(65) Prior Publication Data

US 2003/0165784 A1 Sep. 4, 2003

(30) Foreign Application Priority Data

Aug. 3, 2001 (JP) ..... 2001-236485

(51) Int. Cl.[7] ..... G03C 1/498; G03C 1/00

(52) U.S. Cl. ..... 430/619; 430/567; 430/642

(58) Field of Search ..... 430/264, 619, 430/567, 642

(56) References Cited

U.S. PATENT DOCUMENTS 4,777,110 A * 10/1988 Sawada et al. ..... 430/203
5,667,945 A * 9/1997 Takeuchi et al. ..... 430/380
6,143,488 A 11/2000 Uytterhoeven et al.

* cited by examiner

*Primary Examiner*—Thorl Chea
(74) *Attorney, Agent, or Firm*—Birch, Stewart, Kolasch & Birch, LLP

(57) ABSTRACT

Disclosed is a photothermographic material containing a silver salt of an organic acid, a silver halide and a reducing agent on a transparent support, which has, in silver iodide content distribution of total silver halide grains contained in the photothermographic material plotted with silver iodide content in abscissa and silver content in silver halide grains in ordinate, at least one maximum value in a silver iodide content range of less than 10 mol % and at least one maximum value in a silver iodide content range of 10 mol % or more. The photothermographic material shows low fog, little increase of fog and little sensitivity fluctuation during storage before light exposure.

21 Claims, 1 Drawing Sheet

PHOTOTHERMOGRAPHIC MATERIAL

TECHNICAL FIELD

The present invention relates to a photothermographic material. In particular, the present invention relates to a photothermographic material showing little fog and little sensitivity fluctuation during storage before light exposure as a photothermographic material for laser imagers.

RELATED ART

In the medical field and the field of printing plate making, waste solutions generated with wet processing of image-forming materials have conventionally caused a problem concerning workability, and in recent years, it is strongly desired to reduce the amount of the processing waste solutions also from the standpoints of environmental protection and space saving. Therefore, techniques relating to photothermographic materials that can be efficiently exposed by using laser imagers and can form clear black images with high resolution and sharpness have been noted.

As such techniques, there are known, for example, photothermographic materials containing a silver salt of an organic acid, photosensitive silver halide grains, a reducing agent and a binder on a support, as described in U.S. Pat. Nos. 3,152,904, 3,457,075, D. Morgan, "Dry Silver Photographic Materials" in Handbook of Imaging Materials, Marcel Dekker, Inc., page 48, 1991 and so forth.

However, since photothermographic materials contain all the materials for development within the photosensitive materials, they suffer from a drawback that storability before development is markedly poorer compared with photosensitive materials for wet processing.

For use in photomechanical processes for printing, a substantially colorless photosensitive material (in particular, colorless for the UV region) that can provide high contrast photographic characteristic is required. In a photosensitive material for which exposure with an infrared ray is intended, absorption in the visible region of sensitizing dyes and antihalation dyes can be markedly reduced and hence a substantially colorless photosensitive material can easily be produced. Thus, techniques concerning infrared sensitive photothermographic silver halide photographic materials have been developed. Spectral sensitization techniques are disclosed in Japanese Patent Publication (Kokoku, hereinafter referred to as JP-B) No. 3-10391, JP-B-6-52387, Japanese Patent Laid-open Publication (Kokai, henceforth referred to as JP-A) No. 5-341432, JP-A-6-194781, JP-A-6-301141 and so forth, and antihalation techniques are disclosed in JP-A-7-13295, U.S. Pat. No. 5,380,635 and so forth. Furthermore, as for methods of obtaining high contrast photographic characteristic, European Patent Publication (hereinafter referred to as EP-A) 762,196, JP-A-9-90550 and so forth disclose that high-contrast photographic characteristic can be obtained by incorporating Group VII or VIII metal ions or metal complex ions thereof into photosensitive silver halide grains for use in photothermographic materials, or incorporating a hydrazine derivative into the photothermographic materials.

Meanwhile, photosensitive materials for platemaking are used as intermediate materials in printing process, i.e., as masks for producing printing plates. In recent years, digitization and automation of operations have been widely diffused for the whole printing process, and light exposure and development of PS plates in the platemaking process are automated by the use of platemaking machines. Such platemaking machines serve as systems that operate when information required for automatic transportation, automatic light exposure and so forth (bar code or register mark) written on photothermographic materials is read by sensors of the platemaking machines. These sensors utilize laser diodes of a wavelength around 670 nm. That is, it is indispensable that the information written on the photothermographic materials can be read at a wavelength of 670 nm, and it is preferred that the photothermographic materials should show low Dmin (minimum density) at a wavelength of around 670 nm. In particular, it is preferable to use an antihalation dye showing low absorption in the visible region.

However, dyes providing spectral sensitization by infrared absorption generally show high HOMO and hence strong reducing ability, and thus they are likely to reduce silver ions in photothermographic materials to degrade fog of the photothermographic materials. In particular, during storage under high temperature and high humidity or storage for a long period of time, marked change of performance may be observed. Moreover, if a dye showing low HOMO is used in order to prevent the degradation of storability, LUMO also correspondingly becomes lower. Thus, spectral sensitization efficiency is reduced and hence sensitivity is lowered. These problems concerning sensitivity, storability and performance fluctuation are observed not only in wet type photosensitive materials, but also in photothermographic materials, in which the problems become more serious.

As for photothermographic materials utilizing silver iodide (AgI), methods of using AgI formed by conversion of a silver salt of an organic acid are disclosed in U.S. Pat. No. 6,143,488, EP-A-922,995, International Patent Publications WO97/48014, WO97/48015, U.S. Pat. No. 6,165,705, JP-A-8-297345, Japanese Patent No. 2,785,129 and so forth. However, any of these cannot achieve sensitivity and fog of sufficient levels.

Therefore, there have been desired techniques for providing photothermographic materials that can provide images with low fog as well as little increase of fog and little sensitivity fluctuation during storage before light exposure, and are advantageous for environment and cost.

SUMMARY OF THE INVENTION

Therefore, a first object to be achieved by the present invention is to provide a photothermographic material, in particular for laser imagers, that shows low fog, little increase of fog and little sensitivity fluctuation during storage before light exposure.

The inventor of the present invention assiduously studied, and as a result, found that a superior photothermographic material could be obtained by utilizing silver halide grains of high silver iodide content and silver halide grains of low silver iodide content in combination. Thus, the present invention was accomplished.

That is, the present invention provides a photothermographic material containing a silver salt of an organic acid, a silver halide and a reducing agent on a transparent support, which has two or more maximum values of silver content in silver iodide content distribution of total silver halide grains contained in the photothermographic material plotted with silver iodide content in abscissa and silver content in silver halide grains in ordinate, wherein at least one maximum value is in a silver iodide content range of less than 10 mol % and at least one maximum value is in a silver iodide content range of 10 mol % or more.

The photothermographic material of the present invention preferably satisfies the requirement defined by the following equation (1):

$$\frac{\text{Total amount of silver contained in silver halide having silver iodide content of less than 10 mol \%}}{\text{Total amount of silver contained in silver halide having silver iodide content of 10 mol \% or more}} \times 100 \geqq \text{Average silver iodide content of silver halide having silver iodide content of 10 mol \% or more} \quad \text{Equation (1)}$$

Further, the silver halide having a silver iodide content of less than 10 mol % is preferably a photosensitive silver halide. Furthermore, in the photothermographic material of the present invention, the silver halide having a silver iodide content of less than 10 mol % preferably has an average silver iodide content of 5 mol % or less, and the silver halide having a silver iodide content of 10 mol % or more preferably has an average silver iodide content of 30 mol % or more. Further, the photothermographic material of the present invention preferably contains a high contrast agent.

According to the present invention, there can be provided a photothermographic material that shows low fog, little increase of fog and little sensitivity fluctuation during storage before light exposure. The photothermographic material of the present invention can be used for purposes of a wide range including use in laser imagers.

BEST MODE FOR CARRYING OUT THE INVENTION

Figure 1:
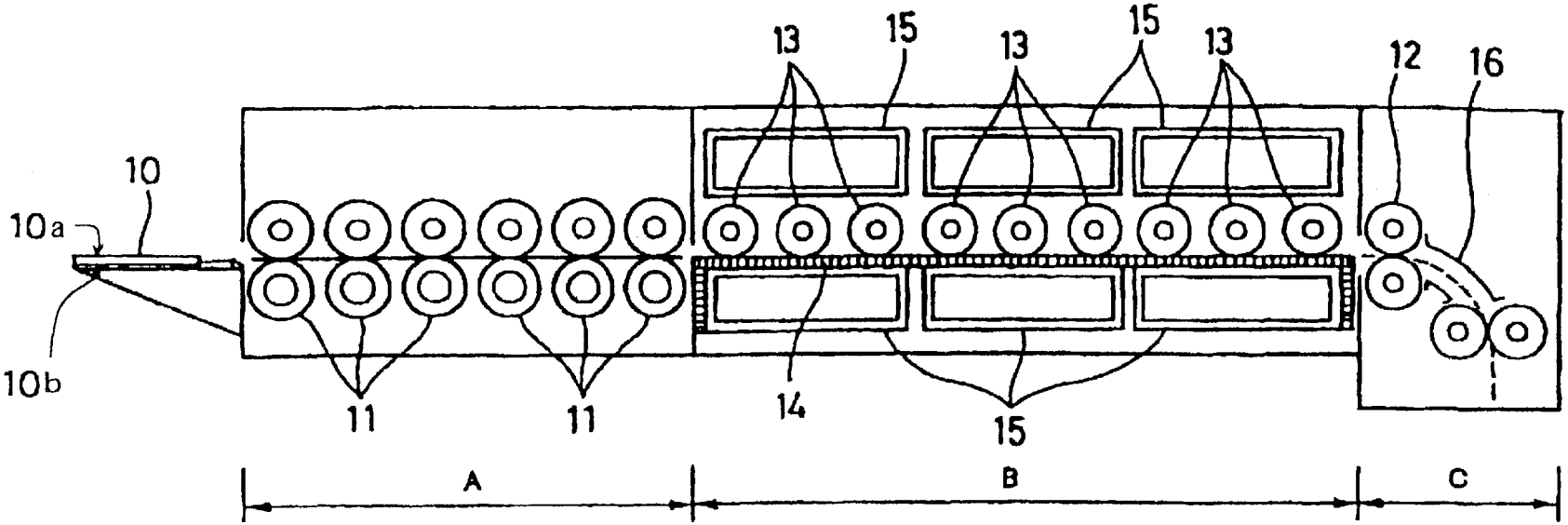
FIG. 1 is a side view of an exemplary heat development apparatus used for heat development of the photothermographic material of the present invention. In the figure, there are shown a photothermographic material 10, taking-in roller pairs 11, taking-out roller pairs 12, rollers 13, a flat surface 14, heaters 15, and guide panels 16. The apparatus consists of a preheating section A, a heat development section B, and a gradual cooling section C.

The photothermographic material of the present invention will be explained in detail hereafter. In the present specification, ranges indicated with "-" mean ranges including the numerical values before and after "-" as the minimum and maximum values, respectively.

The photothermographic material of the present invention is a photothermographic material containing a silver salt of an organic acid, a silver halide and a reducing agent on a transparent support. It is characterized by having, in silver iodide content distribution of total silver halide grains contained in the photothermographic material plotted with silver iodide content in abscissa and silver content in the silver halide grains in ordinate, at least one maximum value in a silver iodide content range of less than 10 mol % and at least one maximum value in a silver iodide content range of 10 mol % or more.

The silver halide having a silver iodide content of less than 10 mol % used for the photothermographic material of the present invention is preferably a photosensitive silver halide. The photosensitive silver halide preferably has a silver iodide content of 5 mol % or less, more preferably 2 mol % or less. Silver halide of high silver iodide content generally shows low sensitivity, and it is considered to have low value for use in the photographic industry. However, as a result of studies of the inventor of the present invention, it was found that a silver halide having a high silver iodide content exhibited antifogging property in a photothermographic material containing an silver salt of an organic acid and a reducing agent, and sensitivity and fog could be reconciled and storability before development of the photosensitive material could be improved, which was the object of the present invention, with use of such a silver halide by mixing it with the aforementioned photosensitive silver halide.

Among the silver halides used in the present invention, the silver halide having a silver iodide content of 10 mol % or more is used as an antifoggant. The silver iodide content should be 10 mol % more, preferably 30 mol % or more, more preferably 60 mol % or more, still more preferably 90 mol % or more. A higher silver iodide content provides the effect of the present invention more distinctly. However, when the silver iodide content of the silver halide having a silver iodide content of 10 mol % or more is low, it can be compensated by increasing the amount of the silver halide.

The photothermographic material of the present invention preferably satisfies the requirement defined by the aforementioned equation (1). When the requirement defined by the aforementioned equation (1) is satisfied, inhibition of development by iodine is hardly occur and therefore high sensitivity can favorably be maintained.

The halogen composition of the silver halide is not particularly limited so long as the aforementioned silver iodide content range is satisfied, and it may consist of mixed crystals of silver chloride, silver chlorobromide and silver bromide. The halogen composition of silver halide contained in the photothermographic material can be analyzed by the X-ray diffraction, SEM-EDAX or the like. Silver iodide contents and silver amounts of the individual emulsion grains can be measured by analyzing compositions of the individual grains using an X-ray microanalyser.

The measurement method therefor is disclosed in, for example, EP-A-147,868.

When distribution of silver iodide contents in individual grains in an emulsion of the present invention is determined, it is desirably determined by measuring silver iodide contents for at least 100 grains, more preferably 200 or more of grains, particularly preferably 300 or more of grains.

The measured silver iodide contents are plotted in abscissa with silver amounts in ordinate. The photothermographic material of the present invention has at least one maximum value in the silver iodide content range of less than 10 mol % and at least one maximum value in the silver iodide content range of 10 mol % or more.

Sensitivity of the silver halide will be explained hereafter.

The silver halide having a silver iodide content of less than 10 mol % should function as a photosensor of the photothermographic material, and the silver halide having a silver iodide content of 10 mol % or more should function as an antifoggaint. Therefore, the silver halide having a silver iodide content of less than 10 mol % preferably has high sensitivity, but the silver halide having a silver iodide content of 10 mol % or more may not substantially have photosensitivity. Therefore, the silver halide having a silver iodide content of 10 mol % or more may not necessarily be doped with metal in the grains or subjected to chemical sensitization for sensitization.

Although grain size of the silver halide having a silver iodide content of 10 mol % or more can be arbitrarily selected, it is preferably similar to the grain size of the silver halide having a silver iodide content of less than 10 mol %, since a too large grain size degrades haze of the photothermographic material. Further, its grain size distribution is preferably monodispersed, like the silver halide having a silver iodide content of less than 10 mol %.

The silver halide used for the photothermographic material of the present invention can be prepared by any method known in the field of photographic techniques including the single jet method and double jet method, and they can also be prepared by, for example, any of the ammonia emulsion method, neutral method, acidic method and so forth.

In order to mix the photosensitive silver halide and the silver salt of an organic acid to obtain sufficient contact of them as described later, there can be used, for example, means of using polymer other than gelatin such as polyvinyl acetals described in U.S. Pat. Nos. 3,706,564, 3,706,565, 3,713,833, 3,748,143 and British Patent No. 1,362,970 as a protective polymer during the preparation of the photosensitive silver halide, means of enzymatically decomposing gelatin of the photosensitive silver halide emulsion as described in British Patent No. 1,354,186, means of preparing the photosensitive silver halide grains in the presence of a surfactant to omit use of protective polymer as disclosed in U.S. Pat. No. 4,076,539 and so forth.

The silver halide having silver iodide content of less than 10 mol % functions as a photosensor, and preferably has a small grain size in order to reduce cloudiness after the image formation and improve quality of formed images. The mean grain size is preferably 0.12 $\mu$m or less, more preferably 0.01–0.1 $\mu$m, particularly preferably 0.02–0.08 $\mu$m. The grain size used herein means a ridge length of a silver halide grain for normal crystals including cubic crystals and octahedral crystals, or a diameter of a sphere having the same volume as a silver halide grain for crystals that are not normal crystals, e.g., spherical grains, rod-like grains and tabular grains. The silver halide is preferably monodispersed. The monodispersed state used herein means that the monodispersion degree obtained according to the following equation is 40% or less. More preferred are grains showing a monodispersion degree of 30% or less, particularly preferably 0.1–25%.

$$\text{Monodispersion degree}=\{(\text{Standard deviation of grain size})/(\text{Average of grain size})\}\times 100$$

In the present invention, the silver halide grains are more preferably monodispersed grains having a mean grain size of 0.12 $\mu$m or less. With grains falling within such a range, graininess of image is also improved.

The form of silver halide grains is not particularly limited, and examples of the grains include the so-called normal crystals such as cubic grains and octahedral grains, and grains that are not normal crystals such as spherical grains, rod-like grains and tabular grains. In the present invention, cubic grains and tabular grains are particularly preferred. As for the characteristics of the grain form such as aspect ratio and surface index of the grains, they may be similar to those described in JP-A-11-119374, paragraph 0225. Further, the halogen composition may have a uniform distribution for surface portion and inside of the grains, or the composition may change stepwise or continuously in the grains. Silver halide grains having a core/shell structure may also be preferably used. Core/shell grains having preferably a double to quintuple structure, more preferably a double to quadruple structure may be used. A technique for localizing silver bromide on the surface of silver chloride or silver chlorobromide grains may also be preferably used.

Further, the photosensitive silver halide used in the photothermographic material of the present invention can be produced almost simultaneously with the production of the organic acid silver salt by injecting silver ions into a mixture in which a halogen component such as halide ions and an organic acid silver salt-forming component coexist when the organic acid silver salt is formed, as described in British Patent No. 1,447,454.

Furthermore, it is also possible to allow a silver halide-forming component to act on a preliminarily prepared organic acid silver salt solution or dispersion, or a sheet material containing a silver salt of an organic acid to convert a part of the organic acid silver salt into the photosensitive silver halide. The silver halide prepared as described above effectively contacts with the organic acid silver salt to exhibit a desirable effect. The aforementioned silver halide-forming component is a compound capable of forming a photosensitive silver halide by a reaction with a silver salt of an organic acid. What kinds of compounds correspond to such a compound and are effective as such a compound can be determined by the following simple test. That is, a compound to be tested is mixed with a silver salt of an organic acid and optionally heated. Thereafter, the mixture is examined by X-ray diffractometry to determine whether a diffraction peak characteristic to the silver halide is present or not. Examples of silver halide-forming components that are confirmed as being effective by such a test as described above include inorganic halogenides, onium halides, halogenated hydrocarbons, N-halogenated compounds and other halogen-containing compounds. Specific examples of such compounds are described in detail in U.S. Pat. Nos. 4,009,039, 3,457,075, 4,003,749, British Patent No. 1,498,956, JP-A-53-27027 and JP-A-53-25420.

The silver halide-forming component is used in a stoichiometrically small amount with respect to the amount of the silver salt of an organic acid. The amount is generally in the range of 0.001–0.7 mole, preferably 0.03–0.5 mole, per mole of the silver salt of an organic acid. Two or more kinds of silver halide-forming components may be used within the aforementioned range. Although conditions of the process for converting a part of the silver salt of an organic acid into the silver halide using the silver halide-forming component, such as reaction temperature, reaction time or reaction pressure, can be suitably selected from wide ranges according to the purpose of production, it is generally preferred that the reaction temperature should be 20–70° C., the reaction time be 0.1 seconds to 72 hours, and the reaction pressure be atmospheric pressure. Further, it is preferred that the reaction should be carried out in the presence of a polymer used as a binder described later. The amount of the polymer used in this case is in the range of 0.01–100 parts by weight, preferably 0.1–10 parts by weight, based on 1 part by weight of the silver salt of an organic acid.

The silver halide may be added by any method other than that mentioned above, and it is also preferable to separately prepare silver halide and silver salt of an organic acid and mix them during preparation of a coating solution. Although the addition method of silver halide is not particularly limited, since the silver halide having silver iodide content of 10 mol % or more may not be subjected to spectral sensitization, it is preferable to separately prepare silver halide having silver iodide content of less than 10 mol %, silver halide having silver iodide content of 10 mol % or more and silver salt of an organic acid and mix them during preparation of a coating solution.

The silver halide having silver iodide content of less than 10 mol % prepared by the aforementioned various methods can be chemically sensitized with, for example, sulfur containing compounds, gold compounds, platinum compounds, palladium compounds, silver compounds, tin compounds, chromium compounds or a combination of these. The methods and procedures of chemical sensitization are described in, for example, U.S. Pat. No. 4,036,650, British Patent No. 1,518,850, JP-A-51-22430, JP-A-51-78319 and JP-A-51-81124. In case of converting a part of the silver salt of an organic acid into the photosensitive silver salt using the silver halide-forming component, the sensitization can be carried out in the presence of an amide compound having a low molecular weight as described in U.S. Pat. No. 3,980,482.

Moreover, the photosensitive silver halide may contain ions of metals belonging to Groups VI to XI of the periodic table of elements, such as Rh, Ru, Re, Ir, Os and Fe, complexes thereof or complex ions thereof for illumination intensity failure or control of gradation. In particular, addition of the metals as complex ions is preferred, and for example, Ir complex ions such as $[IrCl_6]^{2-}$ may be added for illumination intensity failure.

As for the chemical sensitization method for the photosensitive silver halide grains used in the present invention, they are preferably chemically sensitized with a chalcogen as well known in the field. That is, sulfur sensitization, selenium sensitization, tellurium sensitization, noble metal sensitization using a gold compound, platinum compound, palladium compound, iridium compound or the like and reduction sensitization can be used.

It is preferred that the photosensitive silver halide used in the photothermographic material of the present invention should be chemically sensitized with a chalcogen compound. Chemical sensitization with a chalcogen compound or gold compound is disclosed in JP-A-9-297370 or JP-A-11-65020. However, these references mention high sensitivity and high Dmax as the effects of the chemical sensitization, and they do not refer to running stability or stabilization of half tone dot % fluctuation. Therefore, the correlation with the object and advantage of the present invention is not recognized in the references. In the present invention, the silver halide grains are preferably subjected to chemical sensitization with a chalcogen compound before they are mixed with the silver salt of an organic acid.

As sulfur sensitizers that can be used for the present invention, there can be mentioned, besides sulfur compounds contained in gelatin, various sulfur compounds, for example, thiosulfates, thioureas, thiazoles, rhodanines and so forth. Specific examples thereof include those mentioned in U.S. Pat. Nos. 1,574,944, 2,278,947, 2,410,689, 2,728,668, 3,501,313 and 3,656,955.

Any selenium compounds conventionally known and mentioned in patent documents can be employed as the selenium sensitizers that can be used in the present invention. That is, a labile selenium compound and/or a non-labile selenium compound is generally used by adding it to an emulsion and stirring it at a high temperature, preferably at 40° C. or higher, for a certain period of time. As the labile selenium compounds, the compounds described in JP-B-41-15748, JP-B-43-13489, JA-A-4-25832, JP-A-4-109240 and so forth are preferably used. Specific examples of the labile selenium compounds include isoselenocyanates (e.g., aliphatic isoselenocyanates such as allyl isoselenocyanate), selenoureas, selenoketones, selenoamides, selenocarboxylic acids (e.g., 2-selenopropionic acid, 2-selenobutyric acid), selenoesters, diacylselenides (e.g., bis(3-chloro-2,6-dimethoxybenzoyl) selenide), selenophosphates, phosphine selenides, colloidal metallic selenium and so forth.

As the non-labile selenium compounds used in the present invention, the compounds described in JP-B-46-4553, JP-B-52-34492 and JP-B-52-34491 are used. Examples of the non-labile selenium compounds include selenious acid, potassium selenocyanide, selenazoles, quaternary salts of selenazoles, diaryl selenides, diaryl diselenides, dialkyl selenides, dialkyl diselenides, 2-selenazolidinedione, 2-selenooxazolidinethione, derivatives thereof and so forth.

Examples of the tellurium sensitizer used for the present invention include the compounds described in JP-A-4-204640, JP-A-4-271341, JP-A-4-333043, JP-A-5-303157, JP-A-6-027573, JP-A-6-175258, JP-A-6-180478, JP-A-6-208186, JP-A-6-208184, JP-A-6-317867, JP-A-7-092599, JP-A-7-098483, JP-A-7-104415, JP-A-7-140579, J. Chem. Soc. Chem. Commun., 635 (1980); S. Patai (compiler), The Chemistry of Organic Selenium and Tellurium Compounds, Vol. 1 (1986); ibid., vol. 2 (1987) and so forth.

In the present invention, chemical sensitization by at least one of selenium sensitization and tellurium sensitization is preferred. Tellurium sensitization is particularly preferred. Moreover, in the present invention, although sulfur sensitization, selenium sensitization and tellurium sensitization may be used each alone and they may be used in any combination, a combination of two or three kinds of them is used as a preferred embodiment.

Although the amount of the chalcogen sensitizer used in the present invention is not particularly limited so long as the effect of the present invention should be exerted, it is preferably $1\times10^{-8}$ to $1\times10^{-1}$ mole, more preferably $1\times10^{-7}$ to $1\times10^{-2}$ mole, per one mole of silver halide.

As gelatin mixed with the silver halide used in the present invention, low molecular weight gelatin is preferably used in order to maintain good dispersion state of the silver halide emulsion in a coating solution containing a silver salt of an organic acid. The low molecular weight gelatin has a molecular weight of 500–60,000, preferably 1,000–40,000. While such low molecular weight gelatin may be added during the formation of grains or dispersion operation after the desalting treatment, it is preferably added during dispersion operation after the desalting treatment. It is also possible to use ordinary gelatin (molecular weight of about 100,000) during the grain formation and use low molecular weight gelatin during dispersion operation after the desalting treatment.

While the concentration of dispersion medium may be 0.05–20 weight %, it is preferably in the range of 5–15 weight % in view of handling. As for type of gelatin, alkali-treated gelatin is usually used. Besides that, however, modified gelatin such as acid-treated gelatin and phthalated gelatin can also be used.

The amount of the photosensitive silver halide per mole of the silver salt of an organic acid is preferably 0.01–0.5 mole, more preferably 0.02–0.3 mole, still more preferably 0.03–0.25 mole, per one mole of the silver salt of an organic acid. Methods and conditions for mixing photosensitive silver halide and silver salt of an organic acid, which are prepared separately, are not particularly limited so long as the effect of the present invention can be attained satisfactorily. Examples thereof include, for example, a method of mixing silver halide grains and silver salt of an organic acid after completion of respective preparations by using a high-speed stirring machine, ball mill, sand mill, colloid mill, vibration mill, homogenizer or the like, or a method of preparing a silver salt of an organic acid with mixing a photosensitive silver halide after preparation at any time during the preparation of the silver salt of an organic acid. For the mixing of them, mixing two or more kinds of aqueous dispersions of the silver salt of an organic acid and two or more kinds of aqueous dispersions of the photosensitive silver salt is preferably used for controlling photographic properties.

The photothermographic material of the present invention is exposed with, in the case of printing use, a light having a wavelength of 750–800 nm. As a plotter used for the light exposure, a plotter utilizing a laser diode (LD) that enables light exposure with an exposure time of $10^{-7}$ second or shorter as a light source is used. Any light source may be used so long as it can emit a light of electromagnetic wave spectrum of desired wavelength range. For example, dye lasers, gas lasers, solid state lasers, semiconductor lasers and so forth can be used. Semiconductor lasers are particularly preferably used in view of space saving and cost saving.

The photothermographic material of the present invention is preferably exposed with overlapped light beams. The term "overlapped" means that a vertical scanning pitch width is smaller than the diameter of the beams. For example, the overlap can be quantitatively expressed as FWHM/vertical-scanning pitch width (overlap coefficient), where the beam diameter is represented as a half width of beam strength (FWHM). In the present invention, it is preferred that this overlap coefficient should be 0.2 or more.

The scanning method of the light source of the plotter used in the present invention is not particularly limited, and the cylinder external surface scanning method, cylinder internal surface scanning method, flat surface scanning method and so forth can be used. Although the channel of light source may be either single channel or multichannel, a multichannel comprising two or more of laser heads is preferred, because it provides high output and shortens writing time. In particular, for the cylinder external surface scanning method, a multichannel carrying several to several tens or more of laser heads is preferably used.

The scanning method of the light source of the plotter preferably used for the present invention is the inner drum method (cylinder internal surface scanning method). The light exposure is attained by scanning the surface of the photothermographic material transported into the inner drum section with a laser light emitted from a laser diode and reflected by a polygon mirror (prism). The exposure time for the main scanning direction is determined by the rotation number of the polygon mirror and the inner diameter of the drum. The main scanning speed on the surface of the photothermographic material of the present invention is preferably 500–1500 m/second, more preferably 1100–1500 m/second.

If a photothermographic material to be exposed shows low haze upon light exposure, it is likely to generate interference fringes and therefore it is preferable to prevent it. As techniques for preventing such interference fringes, there are known a technique of obliquely irradiating a photosensitive material with a laser light as disclosed in JP-A-5-113548, a technique of utilizing a multimode laser as disclosed in WO95/31754 and so forth, and these techniques are preferably used.

Although any method may be used as the heat development process for image formation on the photothermographic material of the present invention, the development is usually performed by heating a photothermographic material exposed imagewise. As preferred embodiments of heat development apparatus to be used, there are heat development apparatuses in which a photothermographic material is brought into contact with a heat source such as heat roller or heat drum as disclosed in JP-B-5-56499, JP-A-9-292695, JP-A-9-297385 and WO95/30934, and heat development apparatuses of non-contact type as disclosed in JP-A-7-13294, WO97/28489, WO97/28488 and WO97/28487. Particularly preferred are the heat development apparatuses of non-contact type, since dimensional stability is critical, in particular, for printing use. That is, a photothermographic material is light-exposed to form a latent image, and then subjected to development preferably in a development apparatus equipped with a preheating section, a heat development section and a gradual cooling section.

The development temperature of the photothermographic material of the present invention in a development apparatus is preferably 80–250° C., more preferably 100–140° C. The development time in the development apparatus is preferably 1–180 seconds, more preferably 5–90 seconds, in total. Further, the heat development speed in the heat development section of the heat development apparatus is preferably 21–100 mm/second, more preferably 27–50 mm/second.

The light-exposed photothermographic material is first heated in the preheating section. The preheating section is provided in order to prevent uneven development caused by dimensional change of the photothermographic material during the heat development. As for the heating in the preheating section, temperature is desirably controlled to be lower than the heat development temperature (for example, lower by about 10–30° C.), and the temperature and time in this section are desirably adjusted so that they should be sufficient for evaporating moisture remaining in the photothermographic material. The temperature is also preferably adjusted to be higher than the glass transition temperature (Tg) of the support of the photothermographic material so that uneven development should be prevented. It is generally preferred that the photothermographic material should be heated at a temperature of 80° C. or higher but lower than 115° C. for 5 seconds or more.

The photothermographic material heated at the preheating section is subsequently heated in the heat development section. In the image formation method of the present invention, the heat development section is provided with heating members on image-forming layer side and back layer side and transportation rollers only on the image-forming layer side with respect to the photothermographic material to be transported. For example, when the photothermographic material is transported so that it should have the image-forming layer on the upper side, there is employed a configuration that no transportation rollers are provided on the lower side of the photothermographic material (back layer side of the photothermographic material) and transportation rollers are provided only on the upper side (image-forming layer side of the photothermographic material) with respect to the transportation plane of the photothermographic material. In the present invention, generation of uneven density and physical deformation are prevented by employing the above configuration of the heat development section.

In the heat development section, the photothermographic material is heated by heating members such as heaters. The heating temperature in the heat development section is a temperature sufficient for the heat development, and it is generally 110–140° C. Since the photothermographic material is subjected to a high temperature of 110° C. or higher in the heat development section, a part of the components contained in the material or a part of decomposition products produced by the heat development may be volatilized. It is known that these volatilized components invite various bad influences, for example, they may cause uneven development, erode structural members of development apparatuses, deposit at low temperature portions as dusts to cause deformation of image surface, adhere to image surface as stains and so forth. As a method for eliminating these influences, it is known to provide a filter on the heat development apparatus, or suitably control air flows in the heat development apparatus. These methods may be effectively used in combination. For example, WO95/30933, WO97/21150 and International Patent Publication in Japanese (Kohyo) No. 10-500496 disclose use of a filter cartridge containing binding absorption particles and having a first vent for taking up volatilized components and a second vent for discharging them in a heating apparatus for heating a film by contact. Further, WO96/12213 and International Patent Publication in Japanese (Kohyo) No. 10-507403 disclose use of a filter consisting of a combination of heat conductive condensation collector and a gas-absorptive microparticle filter. These can be preferably used in the present invention. Further, U.S. Pat. No. 4,518,845 and JP-B-3-54331 disclose structures comprising means for eliminating vapor from a film, pressing means for pressing the film to a heat-conductive member and means for heating the heat-conductive member. Furthermore, WO98/27458 discloses elimination of components volatilized from a film and increasing fog from a surface of the film. These techniques are also preferably used for the present invention.

Temperature distribution in the preheating section and the heat development section is preferably in the range of ±1° C. or less, more preferably ±0.5° C. or less, respectively.

The photothermographic material heated in the heat development section is then cooled in the gradual cooling section. It is preferred that the cooling should be gradually attained so that the photothermographic material should not physically deform, and the cooling rate is preferably 0.5–10° C./second.

An exemplary structure of heat development apparatus used for the image formation method of the present invention is shown in FIG. 1.

FIG. 1 depicts a schematic side view of a heat development apparatus. The heat development apparatus shown in FIG. 1 consists of a preheating section A for preheating a photothermographic material 10, a heat development section B for carrying out the heat development, and a gradual cooling section C for cooling the photothermographic material. The preheating section A comprises taking-in roller pairs 11 (upper rollers are silicone rubber rollers, and lower rollers are aluminum heating rollers). The Heat development section B is provided with multiple rollers 13 on the side contacting with the surface 10*a* of the side of the photothermographic material 10 on which the image-forming layer is formed, and a flat surface 14 adhered with non-woven fabric (composed of, for example, aromatic polyamide, Teflon™ etc.) or the like on the opposite side to be contacted with the back layer side surface 10*b* of the photothermographic material 10. The clearance between the rollers 13 and the flat surface 14 is suitably adjusted to a clearance that allows the transportation of the photothermographic material 10. The clearance is generally about 0–1 mm. In the heat development section B, heaters 15 (panel heaters etc.) are further provided over the rollers 13 and under the flat surface 14 so as to heat the photothermographic material 10 from the image-forming layer side and the back layer side. The gradual cooling section C is provided with taking-out roller pairs 12 for taking out the photothermographic material 10 from the heat development section B and guide panels 16.

The photothermographic material 10 is subjected to heat development while it is transported by the taking-in roller pairs 11 and then by the taking-out roller pairs 12.

After the light exposure, the photothermographic material 10 is carried into the preheating section A. In the preheating section A, the photothermographic material 10 is made into a flat shape, preheated and then transported into the heat development section B by the multiple taking-in rollers 12. The photothermographic material 10 carried into the heat development section B is inserted into the clearance between the multiple rollers 13 and the flat surface 14 and transported by driving of the rollers 13 contacting with the surface 10*a* of the photothermographic material 10, while the back layer side surface 10*b* slides on the flat surface 14. During the transportation, the photothermographic material 10 is heated to a temperature sufficient for the heat development by the heaters 15 from both of the image-forming layer side and the back layer side so that the latent image formed by the light exposure is developed. Then, the photothermographic material 10 it transported into the gradual cooling section C, and made into a flat shape and taken out from the heat development apparatus by the taking-out roller pairs 12.

The materials of the surfaces of the rollers 13 and the member of the flat surface 14 in the heat development section B may be composed of any materials so long as they have heat resistance and they should not cause any troubles in the transportation of the photothermographic material 10. However, the material of surfaces of the rollers 13 is preferably composed of silicone rubber, and the member of the flat surface 14 is preferably composed of non-woven fabric made of aromatic polyamide or Teflon (PTFE). Shape and number of the heaters 15 are not particularly limited so long as they can heat the photothermographic material 10 to a temperature sufficient for the heat development of the material. However, they preferably have such a configuration that heating temperature of each heater can be adjusted freely.

The photothermographic material 10 is heated in the preheating section A comprising the taking-in roller pairs 11 and the heat development section B comprising the heaters 15. Temperature of the preheating section A is desirably controlled to be lower than the heat development temperature (for example, lower by about 10–30° C.), and the temperature and time in this section are desirably adjusted so that they should be sufficient for evaporating solvent contained in the photothermographic material 10. The temperature is also preferably adjusted to be higher than the glass transition temperature (Tg) of the support of the photothermographic material 10 so that uneven development should be prevented. Temperature distribution in the preheating section and the heat development section is preferably in the range of ±1° C. or less, more preferably ±0.5° C. or less.

In the gradual cooling section C, in order to prevent deformation of the photothermographic material 10 due to rapid cooling, the guide panels 16 are preferably composed of a material showing low heat conductivity.

The photothermographic material of the present invention is preferably exposed and heat-developed in an on-line system comprising a plotter (light exposure apparatus), an auto carrier and a heat development apparatus (processor). The auto carrier automatically transports the exposed photothermographic material to the heat development apparatus. Although the transportation mechanism may be based on any of belt conveyor, roller transportation and so forth, roller transportation is preferred. Further, in the auto carrier, there is preferably provided a mechanism for preventing a heat flow from the heat development apparatus side to the plotter side, and for example, a method of blowing a wind to the plotter and the heat development apparatus from a lower position at the center of the auto carrier can be mentioned.

The development is preferably performed with such conditions that the line speed ratio of the preheating section and the heat development section should become 95.0–99.0% and the line speed ratio of the auto carrier and the preheating section should become 90.0–100.0%. If the line speed ratio of the preheating section and the heat development section is less than 95.0% and/or the line speed ratio of the auto carrier and the preheating section is less than 90.0%, scratches or jamming may be caused to degrade the transportability, and it becomes likely that uneven density is unfavorably generated.

The photothermographic material of the present invention is used in the form of, for example, a sheet having a width of 550–650 mm and a length of 1–65 m, and it is incorporated into the heat development system in a state that a part or all of the material is rolled around a core member of cylindrical shape so that the image-forming layer should be exposed to the outside.

The silver salt of an organic acid used for the photothermographic material of the present invention is a reducible silver source, which is relatively stable against light, but forms a silver image when heated to 80° C. or higher in the presence of a light-exposed photocatalyst (latent image of photosensitive silver halide etc.) and a reducing agent. Preferred are silver salts of an organic acid or heteroorganic acid containing a reducible silver ion source, particularly long-chain (10–30, preferably 15–25 carbon atoms) aliphatic carboxylic acids and carboxylic acids having a nitrogen-containing ring. Organic or inorganic silver salt complexes having a total ligand stability constant of 4.0–10.0 with respect to silver ion are also useful. The silver supplying substances preferably account for about 5–70 weight % of the image-forming layer. Preferred examples of silver salts are described in Research Disclosure (henceforth abbreviated as "RD") Nos. 17029 and 29963 and include the followings: salts of organic acids (e.g., salts of gallic acid, oxalic acid, behenic acid, arachidic acid, stearic acid, palmitic acid, lauric acid etc.); silver salts of carboxyalkylthioureas (e.g., 1-(3-carboxypropyl)thiourea, 1-(3-carboxypropyl)-3,3-dimethylthiourea etc.); silver complexes of polymerization product of aldehydes (e.g., formaldehyde, acetaldehyde, butylaldehyde) with hydroxy-substituted aromatic carboxylic acid; hydroxy-substituted acids (e.g., salicylic acid, benzoic acid, 3,5-dihydroxybenzoic acid, 5,5-thiodisalicylic acid); silver salts or complexes of thioenes (e.g., 3-(2-carboxyethyl)-4-hydroxymethyl-4-thiazoline-2-thione, 3-carboxymethyl-4-thiazoline-2-thione); silver complexes or salts of nitrogenic acid selected from the group consisting of imidazole, pyrazole, urazole, 1,2,4-thiazole, 1H-tetrazole, 3-amino-5-benzylthio-1,2,4-triazole and benzotriazole; silver salts of saccharin, 5-chlorosalicylaldoxim etc.; and silver salts of mercaptides. Among these, preferred silver sources are silver behenate, silver arachidate and/or silver stearate.

The silver salt of an organic acid can be obtained by mixing a water-soluble silver compound with a compound that form a complex with silver, and the forward mixing method, reverse mixing method, simultaneous mixing method, controlled double jet method as disclosed in JP-A-9-127643 and so forth are preferably used. For example, an organic acid can be added with an alkali metal salt (e.g., sodium hydroxide, potassium hydroxide etc.) to produce an organic acid alkali metal salt soap (e.g., sodium behenate, sodium arachidate etc.) and then the soap and silver nitrate or the like can be added by the controlled double jet method to prepare crystals of silver salt of an organic acid. As for the preparation method, the method described in JP-A-2000-292882, paragraphs 0019–0021 can be used.

In the present invention, a method of preparing a silver salt of an organic acid by adding an aqueous solution of silver nitrate and a solution of alkali metal salt of an organic acid to a sealable means for mixing liquids can preferably be used. Specifically, the method described in JP-A-2000-33907 can be used.

In the present invention, a dispersing agent soluble in water can be added to the aqueous solution of silver nitrate and the solution of alkali metal salt of an organic acid or reaction mixture during the preparation of the silver salt of an organic acid. Type and amount of the dispersing agent used in this case are specifically mentioned in JP-A-2000-305214, paragraph 0052.

The silver salt of an organic acid used in the present invention is preferably prepared in the presence of a tertiary alcohol. The tertiary alcohol preferably has a total carbon number of 15 or less, more preferably 10 or less. Examples of preferred tertiary alcohols include tert-butanol. However, tertiary alcohol that can be used for the present invention is not limited to it.

The tertiary alcohol used for the present invention may be added at any time during the preparation of the organic acid silver salt, but the tertiary alcohol is preferably used by adding at the time of preparation of the organic acid alkali metal salt to dissolve the alkali metal salt of an organic acid. The tertiary alcohol used in the present invention may be added in any amount of 0.01–10 in terms of the weight ratio to water used as a solvent for the preparation of the silver salt of an organic acid, but preferably added in an amount of 0.03–1 in terms of weight ratio to water.

In any of the methods for preparing crystals of organic acid silver salt mentioned above, silver halide grains may be mixed during the preparation of crystals of organic acid silver salt.

In the present invention, the silver salt of an organic acid preferably has a mean grain size of 2 $\mu$m or less, and it is preferably monodispersed. The monodispersed state used herein is defined by the same equation as that for silver halide mentioned above. The monodispersed state of silver salt of an organic acid has the same meaning as that of silver halide, and when the silver salt of an organic acid shows a dispersion degree of 50% or less, it is morodispersed. More preferred are those grains showing a dispersion degree of 40% or less, particularly preferably 0.1–30%. When grains of the silver salt of an organic acid are, for example, spherical, rod-like or tabular grains, the mean grain size of silver salt of an organic acid means a mean diameter of spheres having the same volumes as grains of the silver salt of an organic acid. The mean grain size is preferably 0.05–10 $\mu$m, particularly preferably 0.05–2.0 $\mu$m. Moreover, the organic acid silver salt of the present invention preferably contains 60% or more of tabular grains with respect to the total silver salt of an organic acid. In the present invention, tabular grains mean those having a ratio of mean grain size and thickness, i.e., the so-called aspect ratio (abbreviated as "AR") calculated in accordance with the following equation, of 3 or more.

$$AR = \text{Mean grain size } (\mu\text{m})/\text{thickness } (\mu\text{m})$$

In order to obtain such a shape of the silver salt of an organic acid, crystals of the organic acid silver salt can be dispersed and ground together with a binder, surfactant and so forth in a ball mill or the like. With such shape of the grains, a photosensitive material showing high density and superior image storability can be obtained.

As methods for determining shape and monodispersion state of the organic acid silver salt, the following methods can be mentioned. The shape of the organic acid silver salt can be determined from a transmission electron microscope image of organic silver salt dispersion. An example of the method for determining monodispesion state is a method comprising obtaining the standard deviation of a volume weight average diameter of the organic acid silver salt, and the monodispesion state is represented by percentage of a value obtained by dividing the standard deviation with the volume weight average diameter (variation coefficient). As a measurement method, for example, the grain size can be determined by irradiating organic acid silver salt dispersed in a liquid with a laser ray and determining an autocorrelation function for change of the fluctuation of the scattered light with time (volume weight average diameter). The average grain size determined by this method is preferably from 0.05–10.0 $\mu$m, more preferably 0.05–2.0 $\mu$m, as in solid fine grain dispersion.

The silver salt of an organic acid used in the present invention is preferably desalted. The desalting method is not particularly limited and any known methods may be used. Known filtration methods such as centrifugal filtration, suction filtration, ultrafiltration and flocculation washing by coagulation may be preferably used. As the method of ultrafiltration, the method described in JP-A-2000-305214 can be used.

For obtaining an organic acid silver salt solid dispersion having a high S/N ratio and a small grain size and being free from coagulation, there is preferably used a dispersion method comprising steps of converting an aqueous dispersion that contains a silver salt of an organic acid as an image-forming medium and contains substantially no photosensitive silver salt into a high-speed flow dispersion, and then releasing the pressure. As such a dispersion method, the method mentioned in JP-A-2000-292882, paragraphs 0027–0038 can be used.

An organic acid silver salt fine grain solid dispersion used for the present invention may consist of a silver salt of an organic acid and water. While the ratio of the silver salt of an organic acid and water is not particularly limited, the ratio of the silver salt of an organic acid is preferably in the range of 5–50 weight %, particularly preferably 10–30 weight %, with respect to the total weight. While it is preferable to use the aforementioned dispersing agent, it is preferably used in a minimum amount within a range suitable for minimizing the grain size, and it is preferably used in an amount of 0.5–30 weight %, particularly preferably 1–15 weight %, with respect to the silver salt of an organic acid.

In the present invention, metal ions selected from Ca, Mg, Zn and Ag are preferably added to the non-photosensitive silver salt of an organic acid. The metal ions selected from Ca, Mg, Zn and Ag are preferably added to the non-photosensitive silver salt of an organic acid in the form of a water-soluble metal salt, not a halide compound. Specifically, they are preferably added in the form of nitrate or sulfate. Addition of halide is not preferred, since it degrades image storability, i.e., so-called printing-out property, of the photosensitive material against light (indoor light, sun light etc.) after the development. Therefore, in the present invention, it is preferable to add the ions in the form of water-soluble metal salts, which are not halide compounds.

The metal ions selected from Ca, Mg, Zn and Ag, which are preferably used in the present invention, may be added any time after the formation of non-photosensitive organic acid silver salt grains and immediately before the coating operation, for example, immediately after the formation of grains, before dispersion, after dispersion, before and after the formation of coating solution and so forth. They are preferably added after dispersion, or before or after the formation of coating solution.

In the present invention, the metal ions selected from Ca, Mg, Zn and Ag are preferably added in an amount of $10^{-3}$ to $10^{-1}$ mole, particularly $5\times10^{-3}$ to $5\times10^{-2}$ mole, per one mole of non-photosensitive silver salt of an organic acid.

In the present invention, the total amount of the silver halide and the silver salt of an organic acid is preferably 0.5–2.2 g in terms of silver per 1 $m^2$ in order to prevent loss of clarity of the photosensitive material. With an amount in such a range, an image of high contrast can be obtained. The amount of the silver halide with respect to the total silver amount is 50% by weight or less, preferably 25% by weight or less, further preferably 0.1–15% by weight.

Hereafter, high contrast agents (nucleating agents) that can be used for the present invention will be explained.

While types of nucleating agents used for the present invention are not particularly limited, examples of well-known nucleating agents include all of the hydrazine derivatives represented by the formula (H) mentioned in JP-A-2000-284399 (specifically, the hydrazine derivatives mentioned in Tables 1–4 of the same) and the hydrazine derivatives described in JP-A-10-10672, JP-A-10-161270, JP-A-10-62898, JP-A-9-304870, JP-A-9-304872, JP-A-9-304871, JP-A-10-31282, U.S. Pat. No. 5,496,695 and EP-A-741,320.

Further, particularly preferably used nucleating agents are the substituted alkene derivatives, substituted isoxazole derivatives and particular acetal compounds represented by the formulas (1) to (3) mentioned in JP-A-2000-284399, more preferably the cyclic compounds represented by the formula (A) or (B) mentioned in the same, specifically Compounds 1–72 mentioned in Chemical Formulas 8 to 12 of the same. Two or more kinds of these nucleating agents may be used in combination.

The aforementioned nucleating agents may be used after being dissolved in water or an appropriate organic solvent such as alcohols (e.g., methanol, ethanol, propanol, fluorinated alcohol), ketones (e.g., acetone, methyl ethyl ketone), dimethylformamide, dimethyl sulfoxide or methyl cellosolve.

They may also be used as an emulsified dispersion mechanically prepared according to an already well known emulsification dispersion method by using an oil such as dibutyl phthalate, tricresyl phosphate, glyceryl triacetate or diethyl phthalate, and an auxiliary solvent such as ethyl acetate or cyclohexanone. Alternatively, the nucleating agents may be used after dispersion of a powder of the nucleating agents in a suitable solvent such as water by using a ball mill, a colloid mill or the like, or by means of ultrasonic wave according to a known method for solid dispersion.

The high contrast agents used in the present invention may be added to any layers on the image-forming layer side of the support. However, they are preferably added to the image-forming layer or a layer adjacent thereto. As for the amount of the high contrast agent, optimum amount may differ depending on grain size, halogen composition, degree of chemical sensitization of silver halide grains, type of inhibitor and so forth, and it cannot be generally defined. However, it is preferably from $1\times10^{-6}$ to 1 mole, particularly preferably from $1\times10^{-5}$ to $5\times10^{-1}$ mole, per mole of silver.

In addition to the aforementioned compounds, the compounds described in U.S. Pat. Nos. 5,545,515, 5,635,339, 5,654,130, WO97/34196, U.S. Pat. No. 5,686,228 and the compounds described in JP-A-11-119372, JP-A-11-133546, JP-A-11-119373, JP-A-11-109564, JP-A-11-95365, JP-A-11-95366 and JP-A-11-149136 may also be used.

In the present invention, a contrast accelerator may be used in combination with the aforementioned nucleating agents for the formation of an ultrahigh contrast image. For example, amine compounds described in U.S. Pat. No. 5,545,505, specifically, AM-1 to AM-5; hydroxamic acids described in U.S. Pat. No. 5,545,507, specifically, HA-1 to HA-11; acrylonitriles described in U.S. Pat. No. 5,545,507, specifically, CN-1 to CN-13; hydrazine compounds described in U.S. Pat. No. 5,558,983, specifically, CA-1 to CA-6; onium salts described in JP-A-9-297368, specifically, A-1 to A-42, B-1 to B-27 and C-1 to C-14 and so forth may be used.

Formic acid and formic acid salts serve as a strongly fogging substance in a photothermographic material containing a non-photosensitive silver salt, a photosensitive silver halide and a binder. In the present invention, content of formic acid or a formic acid salt in the photothermographic material on the side having the image-forming layer containing a photosensitive silver halide is preferably 5 mmol or less, more preferably 1 mmol or less, per 1 mole of silver.

In the photothermographic material the present invention, an acid formed by hydration of diphosphorus pentoxide or a salt thereof is preferably used together with the nucleating agent. Examples of the acid formed by hydration of diphosphorus pentoxide or a salt thereof include metaphosphoric acid (salt), pyrophosphoric acid (salt), orthophosphoric acid (salt), triphosphoric acid (salt), tetraphosphoric acid (salt), hexametaphosphoric acid (salt) and so forth. Particularly preferably used acids formed by hydration of diphosphorus pentoxide or salts thereof are orthophosphoric acid (salt) and hexametaphosphoric acid (salt). Specific examples of the salt are sodium orthophosphate, sodium dihydrogenorthophosphate, sodium hexametaphosphate, ammonium hexametaphosphate and so forth.

The acid formed by hydration of diphosphorus pentoxide or a salt thereof that can be preferably used in the present invention is added to the image-forming layer or a binder layer adjacent thereto in order to obtain the desired effect with a small amount of the acid or a salt thereof.

The acid formed by hydration of diphosphorus pentoxide or a salt thereof may be used in a desired amount (coated amount per $m^2$ of the photothermographic material) depending on the desired performance including sensitivity and fog. However, it can preferably be used in an amount of 0.1–500 $mg/m^2$, more preferably 0.5–100 $mg/m^2$.

In the photothermographic material of the present invention, the silver halide emulsion and/or the silver salt of an organic acid can be further prevented from the production of additional fog or stabilized against the reduction in sensitivity during the stock storage, by an antifoggant, stabilizer or stabilizer precursor. Examples of suitable antifoggant, stabilizer and stabilizer precursor that can be used individually or in combination include thiazonium salts described in U.S. Pat. Nos. 2,131,038 and 2,694,716, azaindenes described in U.S. Pat. Nos. 2,886,437 and 2,444,605, mercury salts described in U.S. Pat. No. 2,728,663, urazoles described in U.S. Pat. No. 3,287,135, sulfocatechols described in U.S. Pat. No. 3,235,652, oximes, nitrons and nitroindazoles described in British Patent No. 623,448, polyvalent metal salts described in U.S. Pat. No. 2,839,405, thiuronium salts described in U.S. Pat. No. 3,220,839, palladium, platinum and gold salts described in U.S. Pat. Nos. 2,566,263 and 2,597,915, halogen-substituted organic compounds described in U.S. Pat. Nos. 4,108,665 and 4,442,202, triazines described in U.S. Pat. Nos. 4,128,557, 4,137,079, 4,138,365 and 4,459,350, phosphorus compounds described in U.S. Pat. No. 4,411,985, compounds described in U.S. Pat. No. 4,546,075, compounds described in U.S. Pat. No. 4,452,885, compounds described in JP-A-59-57234, compounds represented by the formula 1 mentioned in JP-A-2000-122220 (antifoggants) and so forth.

As compounds used as the aforementioned antifoggants for the present invention, commercially available compounds can be used. Alternatively, they can also be synthesized by, for example, the methods described in Chem. Pharm. Bulletin, 31 (8), 2632 (1983); J. Chem. Soc., Section B; Physical Organic Chemistry, Part 1, pp.145–148 (1971); J. Amer. Chem. Soc., 77, 1909 (1955); Org. Prep. Proced. Int., 28 (5), 609 (1996); Chem. Ber., 44, 1236 (1911); J. Amer. Chem. Soc., 60, 2502 (1938); Bull. Soc. Khim. Fr., 25 (3), 173 (1901); Chem. Abstr., 9861 (1960); DE297018; Justus Liebigs Ann. Chem., 300 299, (1898) and so forth.

In the present invention, an oxidizing agent that reduces fog after the development can be used. As such an oxidizing agent, there can be preferably used, for example, the compounds disclosed in JP-A-50-119624, JP-A-50–120328, JP-A-51-121332, JP-A-54-58022, JP-A-56-70543, JP-A-56-99335, JP-A-59-90842, JP-A-61-129642, JP-A-62-129845, JP-A-6-208191, JP-A-7-5621, JP-A-7-2781, JP-A-8-15809, U.S. Pat. Nos. 5,340,712, 5,369,000, 5,464,737, 3,874,946, 4,756,999, 5,340,712, EP-A1-605,981, EP-A1-622,666, EP-A1-631,176, JP-B-54-165, JP-A-7-2781, U.S. Pat. Nos. 4,180,665, 4,442,202 and so forth.

In the present invention, the oxidizing agent is preferably contained in an amount of 10 $mg/m^2$ to 3 $g/m^2$, more preferably 50 $mg/m^2$ to 1 $g/m^2$.

In the present invention, the oxidizing agent may be added in any form of a solution, powder, solid microparticle dispersion or the like, and it is particularly preferably dispersed as solid microparticles in the image-forming layer. A dispersing aid may also be used upon dispersion operation. Further, it may be added as a solution mixed with other additives such as sensitizing dye, reducing agent and toning agent.

As preferred antifoggants, there are preferably used, besides the aforementioned oxidizing agents, the compounds described in U.S. Pat. Nos. 3,874,946, 4,756,999, the compounds disclosed in JP-A-9-288328, paragraphs 0030–0036, the compounds disclosed in JP-A-9-90550, paragraphs 0062–0063, the compounds disclosed in U.S. Pat. Nos. 5,028,523, EP-A-600,587, EP-A-631,176, EP-A-605,981 and so forth.

The photothermographic material of the present invention may contain a benzoic acid compound for the purpose of achieving high sensitivity or preventing fog. The benzoic acid compound used in the present invention may be any benzoic acid derivative, but preferred examples thereof include the compounds described in U.S. Pat. Nos. 4,784,939, 4,152,160, JP-A-9-329863, JP-A-9-329864, JP-A-9-281637 and so forth. The benzoic acid compound may be added to any layer of the photothermographic material, but the layer to which the benzoic acid is added is preferably a layer on the surface having the image-forming layer, more preferably a layer containing a silver salt of an organic acid. The benzoic acid compound may be added at any step during the preparation of the coating solution. In the case of adding the benzoic acid compound to a layer containing a silver salt of an organic acid, it may be added at any step from the preparation of the silver salt of an organic acid to the preparation of the coating solution, but it is preferably added in the period after the preparation of the silver salt of an organic acid and immediately before the coating. The benzoic acid compound may be added in any form such as powder, solution and microparticle dispersion, or it may be added as a solution containing a mixture of the benzoic acid compound with other additives such as a sensitizing dye, reducing agent and toning agent. The benzoic acid compound may be added in any amount. However, the addition amount thereof is preferably from $1\times10^{-6}$ to 2 mole, more preferably from $1\times10^{-3}$ to 0.5 mole, per mole of silver.

Although not essential for practicing the present invention, it is advantageous in some cases to add a mercury (II) salt as an antifoggant to the image-forming layer. Preferred mercury(II) salts for this purpose are mercury acetate and mercury bromide. The addition amount of mercury for use in the present invention is preferably from $1\times10^{-9}$ to $1\times10^{-3}$ mole, more preferably from $1\times10^{-8}$ to $1\times10^{-4}$ mole, per mole of coated silver.

The antifoggant that is particularly preferably used in the present invention is an organic halogenated compound, and examples thereof include the compounds described in JP-A-50-119624, JP-A-50-120328, JP-A-51-121332, JP-A-54-58022, JP-A-56-70543, JP-A-56-99335, JP-A-59-90842, JP-A-61-129642, JP-A-62-129845, JP-A-6-208191, JP-A-7-5621, JP-A-7-2781, JP-A-8-15809, U.S. Pat. Nos. 5,340,712, 5,369,000 and 5,464,737.

The hydrophilic organic halogenated compounds represented by the formula (P) mentioned in JP-A-2000-284399 can be preferably used as the antifoggant. Specifically, the compounds (P-1) to (P-118) mentioned in the same are preferably used.

The amount of the organic halogenated compound is preferably $1\times10^{-5}$ mole to 2 mole/mole Ag, more preferably $5\times10^{-5}$ mole to 1 mole/mole Ag, further preferably $1\times10^{-4}$ mole to $5\times10^{-1}$ mole/mole Ag, in terms of molar amount per mole of Ag (mole/mole Ag). The organic halogenated compounds may be used each alone, or two or more of them may be used in combination.

Further, the salicylic acid derivatives represented by the formula (Z) mentioned in JP-A-2000-284399 can be preferably used as the antifoggant. Specifically, the compounds (A-1) to (A-60) mentioned in the same are preferably used. The amount of the salicylic acid represented by the formula (Z) is preferably $1\times10^{-5}$ mole to $5\times10^{-1}$ mole/mole Ag, more preferably $5\times10^{-5}$ mole to $1\times10^{-1}$ mole/mole Ag, further preferably $1\times10^{-4}$ mole to $5\times10^{-2}$ mole/mole Ag, in terms of molar amount per mole of Ag (mole/mole Ag). The salicylic acid derivatives may be used each alone, or two or more of them may be used in combination.

As antifoggants preferably used in the present invention, formalin scavengers are effective. Examples thereof include the compounds represented by the formula (S) and the exemplary compounds thereof (S-1) to (S-24) mentioned in JP-A-2000-221634.

The antifoggant used for the present invention may be used after being dissolved in water or an appropriate organic solvent such as alcohols (e.g., methanol, ethanol, propanol, fluorinated alcohol), ketones (e.g., acetone, methyl ethyl ketone), dimethylformamide, dimethyl sulfoxide or methyl cellosolve.

Further, it may also be used as an emulsion dispersion mechanically prepared according to an already well known emulsion dispersion method by using an oil such as dibutyl phthalate, tricresyl phosphate, glyceryl triacetate or diethyl phthalate, ethyl acetate or cyclohexanone as an auxiliary solvent for dissolution. Alternatively, it may be used by dispersing powder of it in a suitable solvent such as water using a ball mill, colloid mill, sand grinder mill, MANTON GAULIN, microfluidizer, or by means of ultrasonic wave according to a known method for solid dispersion.

While the antifoggant used in the present invention may be added to any layer on the image-forming layer side, that is, the image-forming layer or another layer on that side, it is preferably added to the image-forming layer or a layer adjacent thereto. The image-forming layer is a layer containing a reducible silver salt (silver salt of an organic acid), preferably such an image-forming layer further containing a photosensitive silver halide.

The photothermographic material of the present invention may contain a mercapto compound, disulfide compound or thione compound with the purposes of controlling the development by inhibiting or accelerating the development and improving storage stability before or after the development and other purposes.

In the case of using a mercapto compound in the present invention, such a compound of any structure may be used but those represented by Ar—SM or Ar—S—S—Ar are preferred, wherein M is a hydrogen atom or an alkali metal atom and Ar is an aromatic ring or condensed aromatic ring containing one or more nitrogen, sulfur, oxygen, selenium or tellurium atoms. The heteroaromatic ring is preferably selected from benzimidazole, naphthimidazole, benzothiazole, naphthothiazole, benzoxazole, naphthoxazole, benzoselenazole, benzotellurazole, imidazole, oxazole, pyrazole, triazole, thiadiazole, tetrazole, triazine, pyrimidine, pyridazine, pyrazine, pyridine, purine, quinoline and quinazolinone. The heteroaromatic ring may have a substituent selected from, for example, the group consisting of a halogen (e.g., Br, Cl), hydroxy, amino, carboxy, alkyl (e.g., alkyl having one or more carbon atoms, preferably 1–4 carbon atoms), alkoxy (e.g., alkoxy having one or more carbon atoms, preferably 1–4 carbon atoms) and aryl (which may have a substituent). Examples of the mercapto substituted heteroaromatic compound include 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobis(benzothiazole), 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4(3H)-quinazolinone, 7-trifluoromethyl-4-quinolinethiol, 2,3,5,6-tetrachloro-4-pyridinethiol, 4-amino-6-hydroxy-2-mercaptopyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methylpyrimidine hydrochloride, 3-mercapto-5-phenyl-1,2,4-triazole, 1-phenyl-5-mercaptotetrazole, sodium 3-(5-mercaptotetrazole)benzenesulfonate, N-methyl-N'-{3-(5-mercaptotetrazolyl)phenyl}urea, 2-mercapto-4-phenyloxazole and so forth. However, the present invention is not limited to these.

The amount of the mercapto compound is preferably 0.0001–1.0 mole, more preferably 0.001–0.3 mole, per mole of silver in the image-forming layer.

The transparent support used in the present invention is preferably a plastic film (e.g., polyethylene terephthalate (PET), polycarbonate, polyimide, nylon, cellulose triacetate, polyethylene naphthalate) in order to prevent thermal deformation of images after development. The support has a thickness of preferably 90–200 $\mu$m, more preferably 100–175 $\mu$m.

The support is preferably subjected to a heat treatment. For the heat treatment of the support, the support is preferably heated to a temperature higher than the glass transition point of the support by 30° C. or more, preferably 35° C. or more, further preferably 40° C. or more, after formation of the film as the support and before coating of the image-forming layer. However, if the support is heated at a temperature exceeding the melting point of the support, the advantage of the present invention can no longer be obtained.

While known methods can be used as the methods for forming film as the support and preparing undercoat layers of the support used for the present invention, the methods described in JP-A-9–50094, paragraphs 0030–0070 are preferably used.

Preferably used as the support of the photothermographic material of the present invention is a polyester film, in particular, polyethylene terephthalate film, subjected to a heat treatment in a temperature range of 130–185° C. in order to relax the internal distortion formed in the film during the biaxial stretching so that thermal shrinkage distortion occurring during the heat development should be eliminated. Such films are described in JP-A-10-48772, JP-A-10-10676, JP-A-10-10677, JP-A-11-65025 and JP-A-11-138648.

After such a heat treatment, the support preferably shows dimensional changes caused by heating at 120° C. for 30 seconds of −0.03% to +0.01% for the machine direction (MD) and 0–0.04% for the transverse direction (TD).

Known methods can be used as the methods for forming film as the support and preparing undercoat layers of the support used for the present invention, and the methods described in JP-A-9-50094, paragraphs 0030–0070 can be used.

The photothermographic material of the present invention can be subjected to an antistatic treatment using the conductive metal oxides and/or fluorinated surfactants disclosed in JP-A-11-84573, paragraphs 0040–0051 for the purposes of reducing adhesion of dusts, preventing generation of static marks, preventing transportation failure during the automatic transportation process and so forth. As the conductive metal oxides, the conductive acicular tin oxide doped with antimony disclosed in U.S. Pat. No. 5,575,957 and JP-A-11-223901, paragraphs 0012–0020 and the fibrous tin oxide doped with antimony disclosed in JP-A-4-29134 can be preferably used.

The layer containing a metal oxide preferably shows a surface specific resistance (surface resistivity) of $10^{12}$ O or less, more preferably $10^{11}$ O or less, in an atmosphere at 25° C. and 20% of relative humidity. Such a resistivity provides good antistatic property. Although the surface resistivity is not particularly limited as for the lower limit, it is usually about $10^{7}$ O.

It is preferred that undercoat layers containing a vinylidene chloride copolymer comprising 70 weight % or more of repetition units of vinylidene chloride monomers should be provided on the both surfaces of the support. Such vinylidene chloride copolymers are disclosed in JP-A-64-20544, JP-A-1-180537, JP-A-1-209443, JP-A-1-285939, JP-A-1-296243, JP-A-2-24649, JP-A-2-24648, JP-A-2-184844, JP-A-3-109545, JP-A-3-137637, JP-A-3-141346, JP-A-3-141347, JP-A-4-96055, U.S. Pat. No. 4,645,731, JP-A-4-68344, Japanese Patent No. 2,557,641, page 2, right column, line 20 to page 3, right column, line 30, JP-A-2000-39684, paragraphs 0020–0037 and JP-A-2000-47083, paragraphs 0063–0080.

If the vinylidene chloride monomer content is less than 70 weight %, sufficient moisture resistance cannot be obtained, and dimensional change with time after the heat development will become significant. The vinylidene chloride copolymer preferably contains repetition units of carboxyl group-containing vinyl monomers, besides the repetition units of vinylidene chloride monomer. A polymer consisting solely of vinylidene chloride monomers crystallizes, and therefore it becomes difficult to form a uniform film when a moisture resistant layer is coated. Further, carboxyl group-containing vinyl monomers are indispensable for stabilizing the polymer. For these reasons, the repetition units of carboxyl group-containing vinyl monomers are added to the polymer.

The vinylidene chloride copolymer used in the present invention preferably has a molecular weight of 45,000 or less, more preferably 10,000–45,000, as a weight average molecular weight. When the molecular weight becomes large, adhesion between the vinylidene chloride copolymer layer and the support layer composed of polyester or the like tends to be degraded.

The content of the vinylidene chloride copolymer used in the present invention is such an amount that the undercoat layers should have a thickness of preferably 0.3 μm or more, more preferably 0.3–4 μm, as a total thickness of the undercoat layers containing the vinylidene chloride copolymer for one side.

The vinylidene chloride copolymer layer as an undercoat layer is preferably provided as a first undercoat layer, which is directly coated on the support, and usually one vinylidene chloride copolymer layer is provided for each side. However, two or more of layers may be provided as the case may be. When vinylidene chloride copolymer layer consists of multiple layers of two or more layers, it is preferred that the total amount of vinylidene chloride copolymer should be within the aforementioned range.

Such an undercoat layer may contain a crosslinking agent, matting agent or the like, in addition to the vinylidene chloride copolymer.

The support may be coated with an undercoat layer comprising SBR, polyester, gelatin or the like as a binder, in addition to the vinylidene chloride copolymer layer, as required. Such an undercoat layers may have a multilayer structure, and may be provided on one side or both sides of the support. The undercoat layer generally has a thickness (per layer) of 0.01–5 μm, more preferably 0.05–1 μm.

The photothermographic material of the present invention has a Beck's smoothness of 100–3000 seconds, preferably 100–2000 seconds, for the surface of outermost layer on the photosensitive layer side and a Beck's smoothness of 50–1500 seconds, preferably 50–1000 seconds, for the surface of outermost layer on the back layer side. The Beck's smoothness is an important factor for transferability in a light exposure and heat development system and an automatic platemaking machine in the subsequent process. A Beck's smoothness within the aforementioned ranges does not cause transportation failure at a level that causes a problem for practical use. The level that causes a problem for practical use means a transportation failure ratio of 1% or more.

Beck's smoothness referred to in the present invention can be easily determined according to Japanese Industrial Standard (JIS) P8119, "Test Method for Smoothness of Paper and Paperboard by Beck Test Device" and TAPPI Standard Method T479.

Beck's smoothness of the outermost surfaces of the image-forming layer side and the opposite side of the photothermographic material can be controlled by suitably selecting particle size and amount of matting agent to be contained in the layers constituting the surfaces as described in JP-A-11-84573, paragraphs 0052–0059.

The photosensitive material of the present invention has an image-forming layer on one side of the support, and the uppermost layer on the image-forming layer side preferably has a Vickers hardness of 40–150.

The Vickers hardness referred to in the present invention is defined as hardness that can be measured according to the microhardness measurement method of JIS Z 2251. Specifically, it means a quotient obtained by dividing a load F (kgf) used for forming an indent on a test surface with a diamond indenter of a regular quardrangular pyramid shape having a tip sharp angle of 136° with a surface area of the indent obtained from an average length of diagonal lines of the indent d (mm), and calculated in accordance with the following equation.

$$\text{Vickers hardness (Hv)}=1.8544F/d^2$$

The measurement apparatus must be one conforming to JIS B 7734 (microhardness tester). For example, the measurement is preferably conducted by using MHA-400 (NEC Corp.) at 23° C. and relative humidity of 50%. The hardness is determined when the indenter is pushed into the photosensitive material having a support as a sample for a depth of 50% of the thickness from the uppermost surface as observed by scanning electron microscopy (SEM).

In order to obtain a Vickers hardness within the aforementioned range, a method of adding the hydrophobic binder described below to the uppermost layer, a method of controlling the hardness with a matting agent, a method of adding solid filler to control the hardness and so forth can be used.

As the hydrophobic binder, polyvinyl butyral, cellulose acetate, cellulose acetate butyrate, polyester and polymer latex are particularly preferably used.

The photothermographic material of the present invention has at least one image-forming layer on the support. Although only the image-forming layer may be formed on the support, at least one non-image-forming layer is preferably formed on the image-forming layer. In order to control amount or wavelength distribution of light transmitting the image-forming layer, a filter dye layer may be provided on the same side as the image-forming layer and/or an antihalation dye layer, a so-called backing layer, may be provided on the opposite side, and a dye or pigment may be added to the image-forming layer. Although any compounds showing desired absorption in a desired wavelength range may be used, preferably used are, for example, the dyes described in JP-A-59-6481, JP-A-59-182436, U.S. Pat. Nos. 4,271,263, 4,594,312, EP-A-533,008, EP-A-652,473, JP-A-2-216140, JP-A-4-348339, JP-A-7-191432, JP-A-7-301890 and so forth.

The dyes particularly preferably used in the present invention include the compounds represented by the formulas (1a), (2), (3), (1b) and (1c) mentioned in JP-A-2001-5135, specifically those of Chemical Formulas 86 to 89 mentioned in the same, and the compounds described in JP-A-11-119374, paragraph 0297. These dyes maybe added in any form such as solution, emulsion, solid microparticle dispersion and macromolecule mordant mordanted with the dyes. While the amounts of these compounds are determined depending on the intended absorption, they are generally preferably used in an amount of $1\times10^{-6}$ g to 1 g per 1 $m^2$.

When an antihalation dye is used in the present invention, the dye may be any compound so long as it shows intended absorption in a desired range and sufficiently low absorption in the visible region after development, and provides a preferred absorption spectrum pattern of the back layer. For example, the compounds disclosed in JP-A-11-119374, paragraph 0300 can be used. There can also be used a method of reducing density obtained with a dye by thermal decoloration as disclosed in Belgian Patent No. 733,706, a method of reducing the density by decoloration utilizing light irradiation as disclosed in JP-A-54-17833 and so forth.

When the photothermographic material of the present invention after heat development is used as a mask for the production of printing plate from a PS plate, the photothermographic material after heat development carries information for setting up light exposure conditions of platemaking machine for PS plates or information for setting up platemaking conditions including transportation conditions of mask originals and PS plates and so forth as image information. Therefore, in order to read such information, densities (amounts) of the aforementioned irradiation dye, halation dye and filter dye are limited. Because the information is read by using LED or laser, Dmin (minimum density) in a wavelength region of the sensor must be low, i.e., the absorbance must be 0.3 or less. For example, a platemaking machine S-FNRIII produced by Fuji Photo Film Co., Ltd. uses a light source having a wavelength of 670 nm for a detector for detecting resister marks and a bar code reader. Further, platemaking machines of APML series produced by Shimizu Seisaku Co., Ltd. utilize a light source at 670 nm as a bar code reader. That is, if Dmin (minimum density) around 670 nm is high, the information on the film cannot be correctly detected, and thus operation errors such as transportation failure, light exposure failure and so forth are caused in platemaking machines. Therefore, in order to read information with a light source of 670 nm, Dmin around 670 nm must be low and the absorbance at 660–680 nm after the heat development must be 0.3 or less, more preferably 0.25 or less. Although the absorbance is not particularly limited as for its lower limit, it is usually about 0.10.

The photothermographic material of the present invention is used for forming a photographic image by heat development and preferably a photothermographic material containing at least a reducible silver source (silver salt of an organic acid), a photosensitive silver halide, a developing agent (reducing agent) and optionally a toning agent for suppressing color tone of silver as required, which are usually dispersed in an (organic) binder matrix. The photothermographic material of the present invention is stable at an ambient temperature, but it is developed upon heating to a high temperature (e.g., 80–140° C.) after light exposure. By heating, silver is produced through an oxidation-reduction reaction between the silver salt of an organic acid (which functions as an oxidizing agent) and the reducing agent. This oxidation-reduction reaction is accelerated by catalytic action of a latent image generated with the silver halide upon exposure. The silver produced by the reaction of the silver salt of an organic acid in the exposed area provides a black image and this presents a contrast to the non-exposed area to form an image. This reaction process proceeds without supply of processing solutions such as water from the outside.

The photothermographic material contains a reducing agent. Preferred examples of the reducing agent are disclosed in U.S. Pat. Nos. 3,770,448, 3,773,512, 3,593,863, RD Nos. 17029 and 29963, and include aminohydroxycycloalkenone compounds (e.g., 2-hydroxypiperidino-2-cyclohexenone); esters of aminoreductones (e.g., piperidinohexose reductone monoacetate) acting as precursors of reducing agent; N-hydroxyurea derivatives (e.g., N-p-methylphenyl-N-hydroxyurea); hydrazones of aldehyde or ketone (e.g., anthracenaldehydephenyl hydrazone), phosphor-amide phenols; phosphor-amide anilines; polyhydroxybenzenes (e.g., hydroquinone, tert-butylhydroquinone, isopropylhydroquinone, (2,5-dihydroxyphenyl)methylsulfone); sulfhydroxamic acids (e.g., benzenesulfhydroxamic acid); sulfonamideanilines (e.g., 4-(N-methanesulfonamido)aniline); 2-tetrazolylthiohydroquinones (e.g., 2-methyl-5-(1-phenyl-5-tetrazolylthio)hydroquinone); tetrahydroquinoxalines (e.g., 1,2,3,4-tetrahydroquinoxaline); amidoxims; combination of azines (e.g., aliphatic carboxylic acid aryl hydrazides) and ascorbic acid; combination of polyhydroxybenzene and hydroxylamine, reductone and/or hydrazine; hydroxamic acids; combinations of azine and sulfonamidephenol; a-cyanophenylacetic acid derivatives; combinations of bis-β-naphthol and 1,3-dihydroxybenzene derivative; 5-pyrazolones; sulfonamidephenol reducing agents; 2-phenylinedan-1,3-diones; chromans; 1,4-dihydroxypyridines (e.g., 2,6-dimethoxy-3,5-dicarboethoxy-1,4-dihydropyridine); bisphenols (e.g., bis(2-hydroxy-3-tert-butyl-5-methylphenyl)methane, bis(6-hydroxy-m-tri)mesitol, 2,2-bis(4-hydroxy-3-methylphenyl) propane, 4,5-ethylidene-bis(2-tert-butyl-6-methyl)phenol); ultraviolet-sensitive ascorbic acid derivatives; 3-pyrazolidones and so forth. Particularly preferred as the reducing agent are hindered phenols. Examples of the hindered phenols include the compounds represented by the formula (A) mentioned in JP-A-2001-133924, specifically those of Chemical Formulas 65 and 66 mentioned in the same.

The amount of the reducing agent used in the photothermographic material of the present invention is preferably $1\times10^{-2}$ to 10 moles, particularly preferably $1\times10^{-2}$ to 1.5 moles, per one mole of silver.

In the present invention, the reducing agent may be added in any form such as aqueous solution, organic solvent solution, powder, solid microparticle dispersion and emulsion dispersion. Solid microparticle dispersion is performed by using known pulverization means (e.g., ball mill, vibration ball mill, sand mill, colloid mill, jet mill, roller mill etc.). During the solid microparticle dispersion, a dispersion aid may be used.

The photothermographic material of the present invention desirably contains an additive called toning agent, color tone imparting agent or activation toner (henceforth referred to as "toning agent") together with the components described above. The toning agent has a function of being involved in the oxidation/reduction reaction of the silver salt of an organic acid and the reducing agent to impart a darker color, especially black color, to the produced silver image. Preferred examples of the toning agent are disclosed in RD No. 17029 and include imides (e.g., phthalimide); cyclic imides, pyrazolin-5-ones and quinazolinone (e.g., succinimide, 3-phenyl-2-pyrazolin-5-one, 1-phenylurazole, quinazoline, 2,4-thiazolidinedione); naphthalimides (e.g., N-hydroxy-1,8-naphthalimide); cobalt complexes (e.g., cobalt hexaminetrifluoroacetate), mercaptanes (e.g., 3-mercapto-1,2,4-triazole); N-(aminomethyl)aryldicarboxyimides (e.g., N-(dimethylaminomethyl)phthalimide); blocked pyrazoles, isothiuronium derivatives, and combination of certain kinds of light bleaching agents (e.g., combination of N,N'-hexamethylene(1-carbamoyl-3,5-dimethylpyrazole), 1,8-(3,6-dioxaoctane)bis(isothiuroniumtrifluoroacetate) and 2-(tribromomethylsulfonyl)benzothiazole); melocyanine dyes (e.g., 3-ethyl-5-((3-ethyl-2-benzothiazolinylidene (benzothiazolinylidene))-1-methylethylidene)-2-thio-2,4-oxa zolidinedione); phthalazinone, phthalazinone derivatives and metallic salts thereof (e.g., 4-(1-naphtyl) phthalazinone, 6-chlorophthalazinone, 5,7-dimethyloxyphthalazinone, 2,3-dihydro-1,4-phthalazinone); combination of phthalazinone and sulfinic acid derivative (e.g., 6-chlorophthazinone+sodium benzenesulfinate, 8-methylphthalazinone+sodium p-toluenesulfonate); combination of phthalazine and phthalic acid; combination of phthalazine (including adduct of phthalazine) and at least one compound selected from the group consisting of maleic anhydride, phthalic acid, 2,3-naphthalenedicarboxylic acid, o-phenylenic acid derivative and anhydrides thereof (e.g., phthalic anhydride, 4-methylphthalic anhydride, 4-nitrophthalic anhydride, tetrachlorophthalic anhydride); quinazolinediones, benzoxazines, ortho-oxazine derivatives; benzoxazine-2,4-diones (e.g., 1,3-benzoxazine-2,4-dione); pyrimidines and asymmetric triazines (e.g., 2,4-dihydroxypyrimidine), and tetrazapentalene derivatives (e.g., 3,6-dimercapto-1,4-diphenyl-1H,4H-2,3a,5,6a-tetrazapentalene).

In the present invention, the phthalazine derivatives represented by the formula (F) mentioned in JP-A-2000-35631 are preferably used as the toning agent. Specifically, A-1 to A-10 mentioned in the same are preferably used.

The toning agent may be added in any form of a solution, powder, solid microparticle dispersion or the like. The solid microparticle dispersion is performed by using known pulverization means (e.g., ball mill, vibrating ball mill, sand mill, colloid mill, jet mill, roller mill etc.). At the time of solid microparticle dispersion, a dispersion aid may also be used.

The reducing agent and toning agent may also be a so-called precursor that is derived to effectively function only at the time of development.

The photothermographic material of the present invention preferably has a film surface pH of 6.0 or less, more preferably 5.5 or less, before heat development. While it is not particularly limited as for the lower limit, it is normally around 3 or higher.

For controlling the film surface pH, an organic acid such as phthalic acid derivatives or a nonvolatile acid such as sulfuric acid, and a volatile base such as ammonia are preferably used to lower the film surface pH. In particular, ammonia is preferable to achieve a low film surface pH, because it is highly volatile and therefore it can be removed before coating or heat development. A method for measuring the film surface pH is described in JP-A-2000-294399, paragraph 0123.

As a sensitizing dye that can be used for the present invention, there can be advantageously selected those sensitizing dyes that can spectrally sensitize silver halide grains within a desired wavelength range after they are adsorbed by the silver halide grains and have spectral sensitivity suitable for spectral characteristics of the light source to be used for exposure. For example, as dyes that spectrally sensitize in a wavelength range of 550–750 nm, there can be mentioned the compounds of formula (II) described in JP-A-10-186572, and more specifically, dyes of II-6, II-7, II-14, II-15, II-18, II-23 and II-25 mentioned in the same can be exemplified as preferred dyes.

As dyes that spectrally sensitize in a wavelength range of 750 nm to 1400 nm, there can be mentioned the dyes of formula (I) described in JP-A-11-119374, and sensitizing dyes described in JP-A-63-159841, JP-A-60-140335, JP-A-63-231437, JP-A-63-259651, JP-A-63-304242, JP-A-63-15245, U.S. Pat. Nos. 4,639,414, 4,740,455, 4,741,966, 4,751,175 and 4,835,096. Useful sensitizing dyes that can be used for the present invention are described in RD No. 17643, item IV-A (page 23, December 1978) and ibid., No. 1831, item X (page 437, August 1979) and the references cited therein. In particular, sensitizing dyes having spectral sensitivity suitable for spectral characteristics of light sources of various scanners can be advantageously selected. For example, the compounds described in JP-A-9-34078, JP-A-9-54409 and JP-A-9-80679 are preferably used.

Particularly preferably used sensitizing dyes include the compounds represented by the formulas [1] to [4] mentioned in JP-A-2001-100360, specifically those of Chemical Formulas 5 to 16 mentioned in the same, the compounds of formula (I) described in JP-A-11-119374, and more specifically, dyes of (25), (26), (30), (32), (36), (37), (41), (49) and (54) mentioned in the same and so forth. Further, as dyes forming J-band, those disclosed in U.S. Pat. Nos. 5,510,236, 3,871,887 (Example 5), JP-A-2-96131 and JP-A-59-48753 can be exemplified as preferred dyes. These sensitizing dyes can be used each alone, or two or more of them can be used in combination.

The aforementioned infrared sensitive dyes or spectral sensitizing dyes can be readily synthesized by, for example, the methods described in F. M. Hamer, The Chemistry of Heterocylic Compounds, The Cyanine Dyes and Related Compounds, A. Weissberger ed., Interscience Co., New York (1964), JP-A-3-138638, JP-A-10-73900, International Patent Publication in Japanese (Kohyo) No. 9-510022, U.S. Pat. No. 2,734,900 and British Patent No. 774,779. Further, the production methods are specifically described in JP-A-2000-95958 and so forth.

These sensitizing dyes can be added by the method described in JP-A-11-119374, paragraph 0106. However, the method is not particularly limited to this method.

While the amount of the sensitizing dye used in the present invention may be selected to be a desired amount depending on the performance including sensitivity and fog, it is preferably used in an amount of $10^{-6}$ to 1 mole, more preferably $10^{-4}$ to $10^{-1}$ mole, per mole of silver halide in the photosensitive layer.

In the present invention, two or more kinds of sensitizing dyes can be used in combination or a supersensitizer can be used in order to improve spectral sensitization efficiency. In combination with a sensitizing dye, a dye which itself has no spectral sensitization effect, or a material that absorbs substantially no visible light, but exhibits supersensitization may be incorporated into the emulsion. Useful sensitizing dyes, combinations of dyes that exhibit supersensitization, and materials that show supersensitization are described in, for example, RD No. 17643, page 23, Item 1V-J (December 1978), JP-B-49-25500, JP-B-43-4933, JP-A-59-19032, JP-A-59-192242, JP-A-5-341432 and so forth.

Examples of the supersensitizer used for the present invention include the compounds disclosed in EP-A-587, 338, U.S. Pat. Nos. 3,877,943 and 4,873,184, and compounds selected from heteroaromatic or aliphatic mercapto compounds, heteroaromatic disulfide compounds, stilbenes, hydrazines and triazines, and so forth.

Particularly preferred supersensitizers are heteroaromatic mercapto compounds and heteroaromatic disulfide compounds disclosed in JP-A-5-341432, the compounds represented by the formulas (I) and (II) mentioned in JP-A-4-182639, stilbene compounds represented by the formula (I) mentioned in JP-A-10-111543 and the compounds represented by the formula (I) mentioned in JP-A-11-109547. Specifically, there can be mentioned the compounds of M-1 to M-24 mentioned in JP-A-5-341432, the compounds of d-1) to d-14) mentioned in JP-A-4-182639, the compounds of SS-01 to SS-07 mentioned in JP-A-10-111543 and the compounds of 31, 32, 37, 38, 41–45 and 51–53 mentioned in JP-A-11-109547.

These supersensitizers can be added to the image-forming layer (emulsion layer) preferably in an amount of $10^{-4}$ to 1 mole, more preferably in an amount of 0.001–0.3 mole, per mole of silver halide.

When supersensitization is performed, photosensitivity becomes particularly high. Therefore, when the reducing agent is not inactivated, print out silver is likely to be increased after the development, and it is particularly effective for the present invention. Moreover, when infrared sensitization is performed, the infrared sensitizing dye further has an oxidation/reduction potential that enables reduction of the silver halide or the silver salt of an organic acid to a certain extent. Therefore, silver clusters that become fogged silver are likely to be produced in the presence of the reducing agent that can reduce the aforementioned silver salt of an organic acid even in a dark place. The produced silver clusters also serve as catalyst nuclei and may induce fog. Therefore, there are caused phenomena that storability is degraded during storage in a dark place, print out silver increases when the materials are left in a light place after the development and so forth. Furthermore, since sensitivity of infrared photosensitive materials is extended to the heat radiation region that is out of the region of visible light, they are effective for phenomena that print out silver increases due to heat radiation rays even in a dark place and so forth. In particular, the effect becomes significant in photothermographic materials subjected to infrared spectral sensitization, of which sensitivity is increased with a supersensitizer.

The photothermographic material of the present invention has an image-forming layer containing a silver salt of an organic acid, a reducing agent and a photosensitive silver halide on a support, and at least one protective layer is preferably provided on the image-forming layer. Further, the photothermographic material of the present invention preferably has at least one back layer on the side of the support opposite to the side of the image-forming layer (back surface), and polymer latex is used as binder of the image-forming layer, protective layer and back layer. The use of polymer latex for these layers enables coating with an aqueous system utilizing a solvent (dispersion medium) containing water as a main component. Not only this is advantageous for environment and cost, but also that makes it possible to provide photothermographic materials that generate no wrinkle upon heat development. Further, by using a support subjected to a predetermined heat treatment, there are provided photothermographic materials exhibiting little dimensional change before and after the heat development.

A binder suitable for the photothermographic material of the present invention is transparent or translucent and generally colorless, and examples thereof include natural polymers, synthetic resins, homopolymers and copolymers and other film-forming media. Specific examples thereof include, for example, gelatin, gum arabic, poly(vinyl alcohol), hydroxyethylcellulose, cellulose acetate, cellulose acetate butyrate, poly(vinylpyrrolidone), casein, starch, poly (acrylic acid), poly (methyl methacrylate), poly (vinyl chloride), poly(methacrylic acid), copoly(styrene-maleic anhydride), copoly(styrene-acrylonitrile), copoly(styrene-butadiene), poly (vinyl acetal) (e.g., poly (vinyl formal), poly (vinyl butyral)), poly(ester), poly(urethane), phenoxy resin, poly(vinylidene chloride), poly(epoxide), poly (carbonate), poly (vinyl acetate), cellulose ester, poly (amide) and so forth. Although the binder may be hydrophilic or hydrophobic, it is preferable to use a hydrophobic transparent binder in the present invention in order to reduce fog after heat development. Preferred binders are polyvinyl butyral, cellulose acetate, cellulose acetate butyrate, polyester, polycarbonate, polyacrylic acid, polyurethane and so forth. Among these, polyvinyl butyral, cellulose acetate, cellulose acetate butyrate and polyester are particularly preferably used. Cellulose acetate butyrate is further preferably used.

As another class of preferred binders, polymer latex to be explained below can be mentioned. Among image-forming layers containing a photosensitive silver halide in the photothermographic material of the present invention, at least one layer is preferably an image-forming layer utilizing polymer latex to be explained below in an amount of 50 weight % or more with respect to the total amount of binder. The polymer latex may be used not only in the image-forming layer, but also in the protective layer, back layer or the like. When the photothermographic material of the present invention is used for, in particular, printing use in which dimensional change causes problems, the polymer latex is preferably used also in a protective layer and a back layer. The term "polymer latex" used herein means a dispersion comprising hydrophobic water-insoluble polymer dispersed in a water-soluble dispersion medium as fine particles. The dispersed state may be one in which polymer is emulsified in a dispersion medium, one in which polymer underwent emulsion polymerization, micelle dispersion, one in which polymer molecules have a hydrophilic portion and the molecular chains themselves are dispersed in a molecular state or the like. Polymer latex used in the present invention is described in "Gosei Jushi Emulsion (Synthetic Resin Emulsion)", compiled by Taira Okuda and Hiroshi Inagaki, issued by Kobunshi Kanko Kai (1978); "Gosei Latex no Oyo (Application of Synthetic Latex)", compiled by Takaaki Sugimura, Yasuo Kataoka, Souichi Suzuki and Keishi Kasahara, issued by Kobunshi Kanko Kai (1993); Soichi Muroi, "Gosei Latex no Kagaku (Chemistry of Synthetic Latex)", Kobunshi Kanko Kai (1970) and so forth. The dispersed particles preferably have an average particle size of about 1–50000 nm, more preferably about 5–1000 nm. The particle size distribution of the dispersed particles is not particularly limited, and the particles may have either wide particle size distribution or monodispersed particle size distribution.

The polymer latex used in the present invention may be normal latex of uniform structure or latex of the so-called core/shell type. In the case of core/shell type, use of different glass transition temperatures of core and shell may be preferred.

Preferred range of the glass transition temperature (Tg) of the polymer latex preferably used as the binder in the present invention varies for the protective layer, back layer and image-forming layer. As for the image-forming layer, the glass transition temperature is preferably −30 to 40° C. for accelerating diffusion of photographic elements during the heat development. Polymer latex used for the protective layer or back layer preferably has a glass transition temperature of 25–70° C., because these layers are brought into contact with various apparatuses.

The polymer latex used in the present invention preferably shows a minimum film forming temperature (MFT) of about −30 to 90° C., more preferably about 0–70° C. A film-forming aid may be added in order to control the minimum film forming temperature. The film-forming aid is also referred to as a plasticizer, and consists of an organic compound (usually an organic solvent) that lowers the minimum film forming temperature of the polymer latex. It is explained in, for example, Soichi Muroi, "Gosei Latex no Kagaku (Chemistry of Synthetic Latex)", Kobunshi Kanko Kai (1970).

Examples of polymer species used for the polymer latex used in the present invention include acrylic resin, polyvinyl acetate resin, polyester resin, polyurethane resin, rubber resin, polyvinyl chloride resin, polyvinylidene chloride resin, polyolefin resin, copolymers of monomers constituting these resins and so forth. The polymers may be linear, branched or crosslinked. They may be so-called homopolymers in which a single kind of monomers are polymerized, or copolymers in which two or more different kinds of monomers are polymerized. The copolymers may be random copolymers or block copolymers. The polymers may have a number average molecular weight of about 5,000–1,000,000, preferably about 10,000–100,000. Polymers having a too small molecular weight may unfavorably provide insufficient mechanical strength of the image-forming layer, and those having a too large molecular weight may unfavorably suffer from bad film forming property.

Specific examples of the polymer latex used as the binder of the image-forming layer of the photothermographic material of the present invention include latex of methyl methacrylate/ethyl acrylate/methacrylic acid copolymer, latex of methyl methacrylate/butadiene/itaconic acid copolymer, latex of ethyl acrylate/methacrylic acid copolymer, latex of methyl methacrylate/2-ethylhexyl acrylate/styrene/acrylic acid copolymer, latex of styrene/butadiene/acrylic acid copolymer, latex of styrene/butadiene/divinylbenzene/methacrylic acid copolymer, latex of methyl methacrylate/vinyl chloride/acrylic acid copolymer, latex of vinylidene chloride/ethyl acrylate/acrylonitrile/methacrylic acid copolymer and so forth. More specifically, there can be mentioned latex of methyl methacrylate (33.5 weight %)/ethyl acrylate (50 weight %)/methacrylic acid (16.5 weight %) copolymer, latex of methyl methacrylate (47.5 weight %)/butadiene (47.5 weight %)/itaconic acid (5 weight %) copolymer, latex of ethyl acrylate (95 weight %)/methacrylic acid (5 weight %) copolymer and so forth. Such polymers are also commercially available and examples thereof include acrylic resins such as CEBIAN A-4635, 46583, 4601 (all produced by Dicel Kagaku Kogyo Co., Ltd), Nipol LX811, 814, 821, 820, 857 (all produced by Nippon Zeon Co., Ltd.), VONCORT R3340, R3360, R3370, 4280 (all produced by Dai-Nippon Ink & Chemicals, Inc.); polyester resins such as FINETEX ES650, 611, 675, 850 (all produced by Dai-Nippon Ink & Chemicals, Inc.), WD-size and WMS (both produced by Eastman Chemical); polyurethane resins such as HYDRAN AP10, 20, 30, 40 (all produced by Dai-Nippon Ink & Chemicals, Inc.); rubber resins such as LACSTAR 7310K, 3307B, 4700H, 7132C (all produced by Dai-Nippon Ink & Chemicals, Inc.), Nipol LX410, 430, 435, 438C (all produced by Nippon Zeon Co., Ltd.); polyvinyl chloride resins such as G351, G576 (both produced by Nippon Zeon Co., Ltd.); polyvinylidene chloride resins such as L502, L513 (both produced by Asahi Chemical Industry Co., Ltd.), ARON D7020, D504, D5071 (all produced by Mitsui Toatsu Co., Ltd.); and olefin resins such as CHEMIPEARL S120 and SA100 (both produced by Mitsui Petrochemical Industries, Ltd.) and so forth. These polymers may be used individually or, if desired, as a blend of two or more of them.

The image-forming layer preferably contains 50 weight % or more, more preferably 70 weight % or more, of the aforementioned polymer latex based on the total binder.

If desired, the image-forming layer may contain a hydrophilic polymer in an amount of 50 weight % or less of the total binder, such as gelatin, polyvinyl alcohol, methylcellulose, hydroxypropylcellulose, carboxymethylcellulose and hydroxypropylmethylcellulose. The amount of the hydrophilic polymer is preferably 30 weight % or less, more preferably 15 weight % or less, of the total binder in the image-forming layer.

The image-forming layer is preferably formed by coating an aqueous coating solution and then drying the coating solution. The term "aqueous" as used herein means that water content of the solvent (dispersion medium) in the coating solution is 60 weight % or more. In the coating solution, the component other than water may be a water-miscible organic solvent such as methyl alcohol, ethyl alcohol, isopropyl alcohol, methyl cellosolve, ethyl cellosolve, dimethylformamide and ethyl acetate. Specific examples of the solvent composition include water/methanol=90/10, water/methanol=70/30, water/ethanol=90/10, water/isopropanol=90/10, water/dimethylformamide=95/5, water/methanol/dimethylformamide=80/15/5, and water/methanol/dimethylformamide=90/5/5 (the numerals indicate weight %).

The total amount of the binder in the image-forming layer is preferably 0.2–30 g/m$^2$, more preferably 1–15 g/m$^2$. The image-forming layer may contain a crosslinking agent for crosslinking, surfactant for improving coatability and so forth.

Further, a combination of polymer latexes having different I/O values is also preferably used as the binder of the protective layer. The I/O values are obtained by dividing an inorganicity value with an organicity value, both of which values are based on the organic conceptual diagram described in JP-A-2000-267226, paragraphs 0025–0029.

In the present invention, a plasticizer (e.g., benzyl alcohol, 2,2,4-trimethylpentanediol-1,3-monoisobutyrate etc.) described in JP-A-2000-267226, paragraphs 0021–0025 can be added as required to control the film-forming temperature. Further, a hydrophilic polymer may be added to a polymer binder, and a water-miscible organic solvent may be added to a coating solution as described in JP-A-2000-267226, paragraphs 0027–0028.

First polymer latex introduced with functional groups, and a crosslinking agent and/or second polymer latex having a functional group that can react with the first polymer latex, which are described in JP-A-2000-19678, paragraphs 0023–0041, can also be added to each layer.

The aforementioned functional groups may be carboxyl group, hydroxyl group, isocyanate group, epoxy group, N-methylol group, oxazolinyl group or the like. The crosslinking agent is selected from epoxy compounds, isocyanate compounds, blocked isocyanate compounds, methylolated compounds, hydroxy compounds, carboxyl compounds, amino compounds, ethylene-imine compounds, aldehyde compounds, halogen compounds and so forth. Specific examples of the crosslinking agent include, as isocyanate compounds, hexamethylene isocyanate, Duranate WB40–80D, WX-1741 (Asahi Chemical Industry Co., Ltd.), Bayhydur 3100 (Sumitomo Bayer Urethane Co., Ltd.), Takenate WD725 (Takeda Chemical Industries, Ltd.), Aquanate 100, 200 (Nippon Polyurethane Industry Co., Ltd.), aqueous dispersion type polyisocyanates mentioned in JP-A-9-160172; as an amino compound, Sumitex Resin M-3 (Sumitomo Chemical Co., Ltd.); as an epoxy compound, Denacol EX-614B (Nagase Chemicals Ltd.); as a halogen compound, 2,4-dichloro-6-hydroxy-1,3,5-triazine sodium salt and so forth.

The total amount of the binder for the image-forming layer is preferably in the range of 0.2–30 g/m$^2$, more preferably 1.0–15 g/m$^2$.

The total amount of the binder for the protective layer is preferably in the range of 1–10.0 g/m$^2$, more preferably 2–6.0 g/m$^2$, as an amount providing a film thickness of 3 $\mu$m or more. In the present invention, the thickness of the protective layer is preferably 3 $\mu$m or more, more preferably 4 $\mu$m or more. While the upper limit of the thickness of the protective layer is not particularly limited, it is preferably 10 $\mu$m or less, more preferably 8 $\mu$m or less, in view of coating and drying.

The total amount of the binder for the back layer is preferably in the range of 0.01–10.0 g/m$^2$, more preferably 0.05–5.0 g/m$^2$.

In the present invention, each of these layers may be provided as two or more layers. When the image-forming layer consists of two or more layers, it is preferred that polymer latex should be used as a binder for all of the layers. The protective layer is a layer provided on the image-forming layer, and it may consist of two or more layers. In such a case, it is preferred that polymer latex should be used for at least one of the layers, especially the outermost protective layer. Further, the back layer is a layer provided on an undercoat layer for the back surface of the support, and it may consist of two or more layers. In such a case, it is preferred that polymer latex should be used for at least one of the layers, especially the outermost back layer.

A lubricant may be used in the photothermographic material of the present invention. A lubricant referred to in the present specification means a compound which, when present on a surface of an object, reduces the friction coefficient of the surface compared with that observed when the compound is absent. The type of the lubricant is not particularly limited.

Examples of the lubricant that can be used in the present invention include the compounds described in JP-A-11-84573, paragraphs 0061–0064 and JP-A-2000-47083, paragraphs 0049–0062.

Preferred examples of the lubricant include Cellosol 524 (main component: carnauba wax), Polyron A, 393, H-481 (main component: polyethylene wax), Himicron G-110 (main component: ethylene bisstearic acid amide), Himicron G-270 (main component: stearic acid amide) (all produced by Chukyo Yushi Co., Ltd.), W-1: $C_{16}H_{33}$—O—$SO_3Na$ W-2: $C_{18}H_{37}$—O—$SO_3Na$ and so forth.

The amount of the lubricant is 0.1–50 weight %, preferably 0.5–30 weight %, of the amount of binder in a layer to which the lubricant is added.

In the present invention, water-soluble polymers are preferably used as a thickener for imparting coating property. The water-soluble polymers used in the present invention may be either naturally occurring polymers or synthetic polymers, and types thereof are not particularly limited. Specifically, there are mentioned naturally occurring polymers such as starches (corn starch, starch etc.), seaweeds (agar, sodium arginate etc.), vegetable adhesive substances (gum arabic etc.), animal proteins (glue, casein, gelatin, egg white etc.) and adhesive fermentation products (pullulan, dextrin etc.), semi-synthetic polymers such as semi-synthetic starches (soluble starch, carboxyl starch, dextran etc.) and semi-synthetic celluloses (viscose, methylcellulose, ethylcellulose, carboxymethylcellulose, hydroxyethylcellulose, hydroxypropylcellulose, hydroxypropylmethylcellulose etc.), synthetic polymers such as polyvinyl alcohol, polyacrylamide, polyvinylpyrrolidone, polyethylene glycol, polypropylene glycol, polyvinyl ether, polyethylene-imine, polystyrenesulfonic acid or styrene-sulfonic acid copolymer, polyvinylsulfinic acid or vinyl-sulfinic acid copolymer, polyacrylic acid or acrylic acid copolymer, acrylic acid or acrylic acid copolymer, maleic acid copolymer, maleic acid monoester copolymer and polyacryloylmethyl propanesulfonate or acryloylmethyl propanesulfonate copolymer and so forth.

Among these, water-soluble polymers preferably used are sodium arginate, gelatin, dextran, dextrin, methylcellulose, carboxymethylcellulose, hydroxyethylcellulose, hydroxypropylcellulose, polyvinyl alcohol, polyacrylamide, polyvinylpyrrolidone, polyethylene glycol, polypropylene glycol, polystyrenesulfonic acid or styrenesulfonic acid copolymer, polyacrylic acid or acrylic acid copolymer, maleic acid monoester copolymer, polyacryloylmethyl propanesulfonate or acryloylmethyl propanesulfonate copolymer and so forth, and they are particularly preferably used as a thickener.

Among these, particularly preferred thickeners are gelatin, dextran, methylcellulose, carboxymethylcellulose, hydroxyethylcellulose, polyvinyl alcohol, polyacrylamide, polyvinylpyrrolidone, polystyrenesulfonate or styrenesulfonate copolymer, polyacrylic acid or acrylic acid copolymer, maleic acid monoester copolymer and so forth. These compounds are described in detail in "Shin Suiyosei Polymer no Oyo to Shijo (Applications and Market of Water-soluble Polymers, New Edition)", CMC Shuppan, Inc., Ed. by Shinji Nagatomo, Nov. 4, 1988.

The amount of the water-soluble polymers used as a thickener is not particularly limited so long as viscosity is increased when they are added to a coating solution. Their concentration in the solution is generally 0.01–30 weight %, preferably 0.05–20 weight %, particularly preferably 0.1–10 weight %. Viscosity to be increased by the polymers is preferably 1–200 mPa.s, more preferably 5–100 mPa.s, as increased degree of viscosity compared with the initial viscosity. The viscosity is represented by values measured at 25° C. by using a B type rotational viscometer. Upon addition to a coating solution or the like, it is generally desirable that the thickener is added as a solution diluted as much as possible. It is also desirable to perform the addition with sufficient stirring.

Surfactants used in the present invention will be described below. The surfactants used in the present invention are classified into dispersing agents, coating agents, wetting agents, antistatic agents, photographic property controlling agents and so forth depending on the purposes of use thereof, and the purposes can be attained by suitably selecting the surfactants described below and using them. As the surfactants used in the present invention, any of nonionic or ionic (anionic, cationic, betaine) surfactants can be used. Furthermore, fluorine-containing surfactants can also be preferably used.

Preferred examples of the nonionic surfactant include surfactants having polyoxyethylene, polyoxypropylene, polyoxybutylene, polyglycidyl, sorbitan or the like as the nonionic hydrophilic group. Specifically, there can be mentioned polyoxyethylene alkyl ethers, polyoxyethylene alkyl phenyl ethers, polyoxyethylene/polyoxypropylene glycols, polyhydric alcohol aliphatic acid partial esters, polyoxyethylene polyhydric alcohol aliphatic acid partial esters, polyoxyethylene aliphatic acid esters, polyglycerin aliphatic acid esters, aliphatic acid diethanolamides, triethanolamine aliphatic acid partial esters and so forth.

Examples of anionic surfactants include carboxylic acid salts, sulfuric acid salts, sulfonic acid salts and phosphoric acid ester salts. Typical examples thereof are aliphatic acid salts, alkylbenzenesulfonates, alkylnaphthalenesulfonates, alkylsulfonates, a-olefinsulfonates, dialkylsulfosuccinates, a-sulfonated aliphatic acid salts, N-methyl-N-oleyltaurine, petroleum sulfonates, alkylsulfates, sulfated fats and oils, polyoxyethylene alkyl ether sulfates, polyoxyethylene alkyl phenyl ether sulfates, polyoxyethylene styrenylphenyl ether sulfates, alkyl phosphates, polyoxyethylene alkyl ether phosphates, naphthalenesulfonate formaldehyde condensates and so forth.

Examples of the cationic surfactants include amine salts, quaternary ammonium salts, pyridinium salts and so forth, and primary to tertiary amine salts and quaternary ammonium salts (tetraalkylammonium salts, trialkylbenzylammonium salts, alkylpyridinium salts, alkylimidazolium salts etc.) can be mentioned.

Examples of betaine type surfactants include carboxybetaine, sulfobetaine and so forth, and N-trialkyl-N-carboxymethylammonium betaine, N-trialkyl-N-sulfoalkyleneammonium betaine and so forth can be mentioned.

These surfactants are described in Takao Kariyone, "Kaimen Kasseizai no Oyo (Applications of Surfactants)", Saiwai Shobo, Sep. 1, 1980). In the present invention, amounts of the preferred surfactants are not particularly limited, and they can be used in an amount providing desired surface activating property. The coating amount of the fluorine-containing surfactant is preferably 0.01–250 mg per 1 $m^2$.

Specific examples of the surfactants are mentioned below. However, the surfactants that can be used in the present invention are not limited to these (—$C_6H_4$— represents phenylene group in the following formulas).

WA-1: $C_{16}H_{33}(OCH_2CH_2)_{10}OH$

WA-2: $C_9H_{19}$—$C_6H_4$—$(OCH_2CH_2)_{12}OH$

WA-3: Sodium dodecylbenzenesulfonate

WA-4: Sodium tri(isopropyl)naphthalenesulfonate

WA-5: Sodium tri(isobutyl)naphthalenesulfonate

WA-6: Sodium dodecylsulfate

WA-7: a-Sulfasuccinic acid di(2-ethylhexyl) ester sodium salt

WA-8: $C_8H_{17}$—$C_6H_4$—$(CH_2CH_2O)_3(CH_2)_2SO_3K$

WA-10: Cetyltrimethylammonium chloride

WA-11: $C_{11}H_{23}CONHCH_2CH_2N^{(+)}(CH_3)_2$—$CH_2COO^{(-)}$

WA-12: $C_8F_{17}SO_2N(C_3H_7)(CH_2CH_2O)_{16}H$

WA-13: $C_8F_{17}SO_2N(C_3H_7)CH_2COOK$

WA-14: $C_8F_{17}SO_3K$

WA-15: $C_8F_{17}SO_2N(C_3H_7)(CH_2CH_2O)_4(CH_2)_4SO_3Na$

WA-16: $C_8F_{17}SO_2N(C_3H_7)(CH_2)_3OCH_2CH_2N^{(+)}(CH_3)_3$—$CH_3.C_6H_4$—$SO_3^{(-)}$

WA-17: $C_8F_{17}SO_2N(C_3H_7)CH_2CH_2CH_2N^{(+)}(CH_3)_2$—$CH_2COO^{(-)}$

In a preferred embodiment of the present invention, an intermediate layer may be provided as required in addition to the image-forming layer and the protective layer. To improve the productivity or the like, it is preferred that these multiple layers should be simultaneously coated as stacked layers by using aqueous systems. While extrusion coating, slide bead coating, curtain coating and so forth can be mentioned as the coating method, the slide bead coating method shown in JP-A-2000-2964, FIG. 1 is particularly preferred.

Silver halide photographic photosensitive materials utilizing gelatin as a main binder are rapidly cooled in a first drying zone, which is provided downstream from a coating dye. As a result, the gelatin gels and the coated film is solidified by cooling. The coated film that no longer flows as a result of the solidification by cooling is transferred to a second drying zone, and the solvent in the coating solution is evaporated in this drying zone and subsequent drying zones so that a film is formed. As drying method after the second drying zone, there can be mentioned the air loop method where a support held by rollers is blown by air jet from a U-shaped duct, the helix method (air floating method) where the support is helically wound around a cylindrical duct and dried during transportation and so forth.

When the layers are formed by using coating solutions comprising polymer latex as a main component of binder, the flow of the coating solution cannot be stopped by rapid cooling. Therefore, the pre-drying may be insufficient only with the first drying zone. In such a case, if such a drying method as utilized for silver halide photographic photosensitive materials is used, uneven flow or uneven drying may occur, and therefore serious defects are likely to occur on the coated surface.

The preferred drying method for the present invention is such a method as described in JP-A-2000-2964, where the drying is attained in a horizontal drying zone irrespective of the drying zone, i.e., the first or second drying zone, at least until the constant rate drying is finished. The transportation of the support during the period immediately after the coating and before the support is introduced into the horizontal drying zone may be performed either horizontally or not horizontally, and the rising angle of the material with respect to the horizontal direction of the coating machine may be within the range of 0–70°. Further, in the horizontal drying zone used in the present invention, the support may be transported at an angle within ±15° with respect to the horizontal direction of the coating machine, and it does not mean exactly horizontal transportation.

The "constant rate drying" referred to in the present specification means a drying process in which all entering calorie is consumed for evaporation of solvent at a constant liquid film temperature. "Decreasing rate drying" referred to in the present specification means a drying process where the drying rate is reduced by various factors (for example, diffusion of moisture in the material for transfer becomes a rate-limiting factor, evaporation surface is recessed etc.) in an end period of the drying, and imparted calorie is also used for increase of liquid film temperature. The critical moisture content for the transition from the constant rate drying to the decreasing rate drying is 200–300%. When the constant rate drying is finished, the drying has sufficiently progressed so that the flowing should be stopped, and therefore such a drying method as used for silver halide photographic photosensitive materials may also be employable. In the present invention, however, it is preferred that the drying should be performed in a horizontal drying zone until the final drying degree is attained even after the constant rate drying.

As for the drying condition for forming the image-forming layer and/or protective layer, it is preferred that the liquid film surface temperature during the constant rate drying should be higher than minimum film forming temperature (MTF) of polymer latex (MTF of polymer is usually higher than glass transition temperature Tg of the polymer by 3–5° C.). In many cases, it is usually selected from the range of 25–40° C., because of limitations imposed by production facilities. Further, the dry bulb temperature during the decreasing rate drying is preferably lower than Tg of the support (in the case of PET, usually 80° C. or lower). The "liquid film surface temperature" referred to in this specification means a solvent liquid film surface temperature of coated liquid film coated on a support, and the "dry bulb temperature" means a temperature of drying air blow in the drying zone.

If the constant rate drying is performed under a condition that lowers the liquid film surface temperature, the drying is likely to become insufficient. Therefore, the film-forming property of the protective layer is markedly degraded, and it becomes likely that cracks will be generated on the film surface. Further, film strength also becomes weak and thus it becomes likely that there arise serious problems, for example, the film becomes liable to suffer from scratches during transportation in a light exposure apparatus or heat development apparatus.

On the other hand, if the drying is performed under a condition that elevates the liquid film surface temperature, the protective layer mainly consisting of polymer latex rapidly becomes a film, but the under layers including the image-forming layer have not lost flowability, and hence it is likely that unevenness is formed on the surface. Furthermore, if the support (base) is subjected to a temperature higher than its Tg, dimensional stability and resistance to curling of the photosensitive material tends to be degraded.

While the same shall apply to the serial coating, in which an under layer is coated and dried and then an upper layer is coated, as for properties of coating solutions for the case where an upper layer and a lower layer are simultaneously coated as stacked layers by coating the upper layer before drying of the lower layer and the both layers are dried simultaneously, in particular, a coating solution for the image-forming layer and a coating solution for protective layer preferably show a pH difference of 2.5 or less, and a smaller value of this pH difference is more preferred. If the pH difference of the coating solutions becomes large, it becomes likely that microscopic aggregations are generated at the interface of the coating solutions and thus it becomes likely that serious defects of surface condition such as coating stripes occur during continuous coating for a long length.

The coating solution for the image-forming layer preferably has a viscosity of 15–100 mPa.S, more preferably 40–70 mPa.S, at 25° C. The coating solution for the protective layer preferably has a viscosity of 5–75 mPa.S, more preferably 30–60 mPa.S, at 25° C. These viscosities are measured by using a B-type viscometer.

The rolling up after the drying is preferably carried out under conditions of a temperature of 20–30° C. and a relative humidity of 45±20%. As for rolled shape, the material may be rolled so that the surface of the image-forming layer side should be toward the outside or inside of the roll according to a shape suitable for subsequent processing. Further, it is also preferred that, when the material is further processed in a rolled shape, the material should be rolled up into a shape of roll in which the sides are reversed compared with the original rolled shape during processing, in order to eliminate the curl generated while the material is in the original rolled shape. Relative humidity of the photosensitive material is preferably controlled to be in the range of 20–55% (measured at 25° C.).

The "curling value" used in the present invention is a value including the curl generated while the material is in a shape during the production. Measurement of the curling value is performed by cutting out a sheet of a width of 610 mm×a length of 454 mm from a light-shielded photosensitive material roll in a produced shape, conditioning it for moisture content at 25° C. and relative humidity of 60% for 3 hours, and then measuring rise of the sheet due to curl when the sheet is horizontally placed on a flat base. When it rises to the photosensitive layer side, the value is represented as a positive value, and when it rises to the back layer side, the value is represented as a negative value.

In the present invention, the "curling value" is 10 to −50 mm, preferably 0 to −30 mm. A larger absolute value of the curling value invites a higher system transportation failure ratio.

In conventional coating solutions for photographic emulsions, which are viscous solutions containing silver halide and gelatin as a base, air bubbles are dissolved in the solutions and eliminated only by feeding the solution by pressurization, and air bubbles are scarcely formed even when the solutions are placed under atmospheric pressure again for coating. However, as for the coating solution for the image-forming layer containing dispersion of silver salt of organic acid, polymer latex and so forth preferably used in the present invention, only feeding of it by pressurization is likely to result in insufficient degassing. Therefore, it is preferably fed so that air/liquid interfaces should not be produced, while giving ultrasonic vibration to perform degassing.

In the present invention, the degassing of a coating solution is preferably performed by a method where the coating solution is degassed under reduced pressure before coating, and further the solution is maintained in a pressurized state at a pressure of 1.5 kg/cm$^2$ or more and continuously fed so that air/liquid interfaces should not be formed, while giving ultrasonic vibration to the solution. Specifically, the method disclosed in JP-B-55-6405 (from page 4, line 20 to page 7, line 11) is preferred. As an apparatus for performing such degassing, the apparatus disclosed in JP-A-2000-98534, examples and FIG. 3 is preferably used.

The pressurization condition is preferably 1.5 kg/cm$^2$ or more, more preferably 1.8 kg/cm$^2$ or more. While the pressure is not particularly limited as for its upper limit, it is usually about 5 kg/cm$^2$ or less. Ultrasonic wave given to the solution should have a sound pressure of 0.2 V or more, preferably 0.5 V to 3.0 V. Although a higher sound pressure is generally preferred, an unduly high sound pressure provides high temperature portions due to cavitation, which may cause fogging. While frequency of the ultrasonic wave is not particularly limited, it is usually 10 kHz or higher, preferably 20–200 kHz. The degassing under reduced pressure means a process where a coating solution is placed in a sealed tank (usually a tank in which the solution is prepared or stored) under reduced pressure to increase diameters of air bubbles in the coating solution so that degassing should be attained by buoyancy imparted to the air bubbles. The reduced pressure condition for the degassing under reduced pressure is −200 mmHg or a pressure condition lower than that, preferably −250 mmHg or a pressure condition lower than that. Although the lower limit of the pressure condition is not particularly limited, it is usually about −800 mmHg or higher. Time under the reduced pressure is preferably 30 minutes or more, more preferably 45 minutes or more, and its upper limit is not particularly limited.

EXAMPLES

The present invention will be further specifically explained with reference to the following examples. The materials, amounts, ratios, types of procedure, orders of procedure and so forth shown in the following examples can be optionally changed so long as such change does not depart from the spirit of the present invention. Therefore, the scope of the present invention is not limited by the following examples.

<Example 1>

<<Preparation of Silver Halide Emulsion A>>

In 700 mL of water, 11 g of alkali-treated gelatin (calcium content: 2700 ppm or less), 30 mg of potassium bromide and 1.3 g of sodium 4-methylbenzenesulfonate were dissolved. After the solution was adjusted to pH 6.5 at a temperature of 40° C., 159 mL of an aqueous solution containing 18.6 g of silver nitrate and an aqueous solution containing 1 mol/L of potassium bromide, $5\times10^{-6}$ mol/L of $(NH_4)_2RhCl_5$ $(H_2O)$ and $2\times10^{-5}$ mol/L of $K_3IrCl_6$ were added over 6 minutes and 30 seconds by the controlled double jet method. Then, 476 mL of an aqueous solution containing 55.5 g of silver nitrate and a halide salt aqueous solution containing 1 mol/L of potassium bromide and $2\times10^{-5}$ mol/L of $K_3IrCl_6$ were added by the controlled double jet method over 28 minutes and 30 seconds while pAg was maintained at 7.7. Then, the pH was lowered to cause coagulation precipitation to effect desalting, 51.1 g of low molecular weight gelatin having an average molecular weight of 15,000 (calcium content: 20 ppm or less) was added, and pH and pAg were adjusted to 5.9 and 8.0, respectively. The grains obtained were cubic grains having a mean grain size of 0.08 $\mu$m, variation coefficient of 9% for projected area and [100] face ratio of 90%.

The temperature of the obtained silver halide grains was raised to 60° C., and the grains were added with sodium benzenethiosulfonate in an amount of 76 $\mu$mol per mole of silver. After 3 minutes, triethylthiourea was further added in an amount of 71 $\mu$mol per mole of silver, and the grains were ripened for 100 minutes, then added with $5\times10^{-4}$ mol/L of 4-hydroxy-6-methyl-1,3,3a, 7-tetrazaindene and 0.17 g of Compound A, and cooled to 40° C.

Then, while the mixture was maintained at 40° C., it was added with potassium bromide (added as aqueous solution), Sensitizing Dye A (added as solution in ethanol) and Compound B (added as solution in methanol) were added in amounts of $4.7\times10^{-2}$ mole, $12.8\times10^{-4}$ mole and $6.4\times10^{-3}$ mole, respectively, per mole of the silver halide with stirring. After 20 minutes, the emulsion was quenched to 30° C. to complete the preparation of Silver halide emulsion A. Silver halide emulsion A obtained was used for the preparation of coating solution described below. The halogen composition of Silver halide emulsion A can be changed by changing the composition of the halide salt aqueous solution, and emulsions having the halogen compositions mentioned in Table 1 were prepared.

Sensitizing dye A

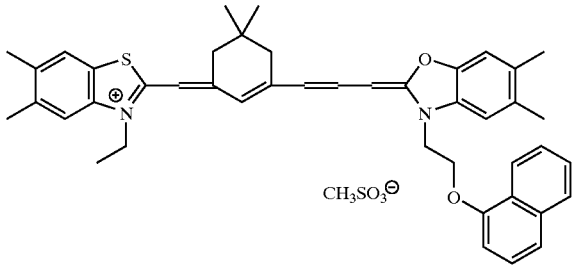

Compound A

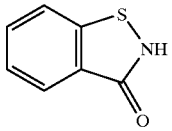

-continued

Compound B

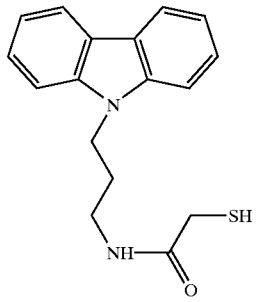

<<Preparation of Silver Halide Emulsion B>>

In a stainless steel reaction vessel, 1420 ml of distilled water, 4.3 ml of 1 weight % potassium iodide solution, 3.5 ml of 0.5 mol/L sulfuric acid and 36.7 g of phthalized gelatin were added and maintained at 40° C. with stirring. Separately, Solution A was prepared by adding distilled water to 22.22 g of silver nitrate to dilute it to 195.6 ml, and Solution B was prepared by diluting 21.8 g of potassium iodide with distilled water to a volume of 218 ml. To the aforementioned mixture in the stainless steel reaction vessel, the whole volumes of Solution A and Solution B were added over 9 minutes at constant flow rates. Further, Solution C was prepared by adding distilled water to 51.86 g of silver nitrate to dilute it to 317.5 ml, and Solution D was prepared by diluting 60 g of potassium iodide with distilled water to a volume of 600 ml. The whole volume of Solution C was added to the above mixture over 120 minutes. Solution D was added by the controlled double jet method while pAg was maintained at 8.1. Then, the mixture was adjusted to pH 3.8 using 0.5 mol/L sulfuric acid, and the stirring was stopped. Thereafter, the mixture was subjected to precipitation, desalting and washing with water, and adjusted to pH 5.9 with sodium hydroxide at a concentration of 1 mol/L to prepare Silver halide emulsion B having pAg of 8.0. The obtained grains were pure silver iodide grains having a mean grain size of 0.04 μm and a variation coefficient of 18% for projected areas. The halogen composition of Silver halide emulsion B can be changed by changing the compositions of Solutions B and D, and emulsions having the halogen compositions mentioned in Table 1 were prepared.

<<Preparation of Silver Behenate Dispersion A>>

In an amount of 87.6 kg of behenic acid (Edenor C22–85R, produced by Henkel Co.), 423 L of distilled water, 49.2 L of 5 mol/L aqueous solution of NaOH and 120 L of tert-butanol were mixed and allowed to react with stirring at 75° C. for one hour to obtain a solution of sodium behenate. Separately, 206.2 L of an aqueous solution containing 40.4 kg of silver nitrate was prepared and kept at 10° C. A mixture of 635 L of distilled water and 30 L of tert-butanol contained in a reaction vessel kept at 30° C. was added with the whole volume of the aforementioned sodium behenate solution and the whole volume of the aqueous silver nitrate solution with stirring at constant flow rates over the periods of 62 minutes and 10 seconds, and 60 minutes, respectively. In this operation, the aqueous silver nitrate solution was added in such a manner that only the aqueous silver nitrate solution should be added for 7 minutes and 20 seconds after starting the addition of the aqueous silver nitrate solution, and then the addition of the aqueous solution of sodium behenate was started and added in such a manner that only the aqueous solution of sodium behenate should be added for 9 minutes and 30 seconds after finishing the addition of the aqueous silver nitrate solution. During the addition, the temperature was controlled so that the temperature in the reaction vessel should be 30° C. and the liquid temperature should not be raised. The piping of the addition system for the sodium behenate solution was warmed by steam trace and the steam amount was controlled so that the liquid temperature at the outlet orifice of the addition nozzle should be 75° C. Further, the piping of the addition system for the aqueous silver nitrate solution was maintained by circulating cold water outside a double pipe. The addition position of the sodium behenate solution and the addition position of the aqueous silver nitrate solution were arranged symmetrically with respect to the stirring axis as the center, and the positions were controlled to be at heights for not contacting with the reaction mixture.

After finishing the addition of the sodium behenate solution, the mixture was left with stirring for 20 minutes at the same temperature and then the temperature was decreased to 25° C. Thereafter, the solid content was recovered by centrifugal filtration and the solid content was washed with water until electric conductivity of the filtrate became 30 μS/cm. The solid content obtained as described above was stored as a wet cake without being dried.

When the shape of the obtained silver behenate grains was evaluated by electron microscopic photography, the grains were scaly crystals having a mean diameter of projected areas of 0.52 μm, mean thickness of 0.14 μm and variation coefficient of 15% for mean diameter as spheres.

Then, dispersion of silver behenate was prepared as follows. To the wet cake corresponding to 100 g of the dry solid content were added 7.4 g of polyvinyl alcohol (PVA-217, produced by Kuraray Co. Ltd., average polymerization degree: about 1700) and water to make the total amount 385 g, and the mixture was pre-dispersed by a homomixer. Then, the pre-dispersed stock dispersion was treated three times by using a dispersing machine (Microfluidizer-M-110S-EH, produced by Microfluidex International Corporation, using G10Z interaction chamber) with a pressure controlled to be 1750 kg/cm$^2$ to obtain Silver behenate dispersion A. During the cooling operation, a desired dispersion temperature was achieved by providing coiled heat exchangers fixed before and after the interaction chamber and controlling the temperature of the refrigerant.

The silver behenate grains contained in Silver behenate dispersion A obtained as described above were grains having a volume weight average diameter of 0.52 μm and variation coefficient of 15%. The measurement of the grain size was carried out by using Master Sizer X produced by Malvern Instruments Ltd. When the grains were evaluated by electron microscopy, the ratio of the long side to the short side was 1.5, the grain thickness was 0.14 μm, and the mean aspect ratio (ratio of diameter as circle of projected area of grain and grain thickness) was 5.1.

Silver behenate dispersion A obtained was used for the preparation of the coating solution described below.

<<Preparation of Solid Microparticle Dispersion of Reducing Agent>>

In an amount of 10 kg of reducing agent [1,1-bis(2-hydroxy-3,5-dimethylphenyl)-3,5,5-trimethylhexane] and 10 kg of 20 weight % aqueous solution of denatured polyvinyl alcohol (Poval MP203, produced by Kuraray Co. Ltd.) were added with 400 g of Safinol 104E (Nisshin Kagaku Co.), 640 g of methanol and 16 kg of water, and mixed sufficiently to form slurry. The slurry was fed by a diaphragm pump to a bead mill of horizontal type (UVM-2, produced by Imex Co.) containing zirconia beads having a mean diameter of 0.5 mm, and dispersed for 3 hours and 30 minutes. Then, the slurry was added with 4 g of benzoisothiazolinone sodium salt and water so that the concentration of the reducing agent should become 25 weight % to obtain a solid microparticle dispersion of reducing agent. The reducing agent particles contained in the obtained dispersion had a median diameter of 0.44 μm, maximum particle diameter of 2.0 μm or less and variation coefficient of 19% for mean particle diameter. The obtained dispersion was filtered through a polypropylene filter having a pore size of 3.0 μm to remove dusts and so forth, and used for the preparation of the coating solution described below.

<<Preparation of Solid Microparticle Dispersion of Organic Polyhalogenated Compound A>>

In an amount of 10 kg of Organic polyhalogenated compound A [tribromomethyl(4-(2,4,6-trimethylphenylsulfonyl)phenyl)sulfone], 10 kg of 20 weight % aqueous solution of denatured polyvinyl alcohol (Poval MP203, produced by Kuraray Co. Ltd.), 639 g of 20 weight % aqueous solution of sodium triisopropylnaphthalenesulfonate, 400 g of Safinol 104E (Nisshin Kagaku Co.), 640 g of methanol and 16 kg of water were mixed sufficiently to form slurry. The slurry was fed by a diaphragm pump to a bead mill of horizontal type (UVM-2, produced by Imex Co.) containing zirconia beads having a mean diameter of 0.5 mm, and dispersed for 5 hours. Then, the slurry was added with water so that the concentration of Organic polyhalogenated compound A should become 25 weight % to obtain solid microparticle dispersion of Organic polyhalogenated compound A. The particles of the organic polyhalogenated compound contained in the obtained dispersion had a median diameter of 0.36 μm, maximum particle diameter of 2.0 μm or less and variation coefficient of 18% for mean particle diameter. The obtained dispersion was filtered through a polypropylene filter having a pore size of 3.0 μm to remove dusts and so forth, and used for the preparation of the coating solution described below.

<<Preparation of Solid Microparticle Dispersion of Organic Polyhalogenated Compound B>>

In an amount of 5 kg of Organic polyhalogenated compound B [tribromomethylnaphthylsulfone], 2.5 kg of 20 weight % aqueous solution of denatured polyvinyl alcohol (Poval MP203, produced by Kuraray Co. Ltd.), 213 g of 20 weight % aqueous solution of sodium triisopropylnaphthalenesulfonate and 10 kg of water were mixed sufficiently to form slurry. The slurry was fed by a diaphragm pump to a bead mill of horizontal type (UVM-2, produced by Imex Co.) containing zirconia beads having a mean diameter of 0.5 mm, and dispersed for 5 hours. Then, the slurry was added with 2.5 g of benzoisothiazolinone sodium salt and water so that the concentration of Organic polyhalogenated compound B should become 23.5 weight % to obtain solid microparticle dispersion of Organic polyhalogenated compound B. The particles of the organic polyhalogenated compound contained in the obtained dispersion had a median diameter of 0.38 μm, maximum particle diameter of 2.0 μm or less and variation coefficient of 20% for mean particle diameter. The obtained dispersion was filtered through a polypropylene filter having a pore size of 3.0 μm to remove dusts and so forth, and used for the preparation of the coating solution described below.

<<Preparation of Aqueous Solution of Organic Polyhalogenated Compound C>>

In an amount of 75.0 mL of water, 8.6 mL of 20 weight % aqueous solution of sodium triisopropylnaphthalenesulfonate, 6.8 mL of 5 weight % aqueous solution of sodium dihydrogenorthophosphate dihydrate and 9.5 mL of 1 mol/L aqueous solution of potassium hydroxide were successively added at room temperature with stirring, and the mixture was stirred for 5 minutes after the addition was completed. Further, the mixture was added with 4.0 g of Organic polyhalogenated compound C [3-tribromomethanesulfonylbenzoylaminoacetic acid] as powder and it was uniformly dissolved to obtain 100 g of transparent solution. The obtained aqueous solution was filtered through a polyester screen of 200 mesh to remove dusts and so forth, and used for the preparation of the coating solution described below.

<<Preparation of Emulsion Dispersion of Compound Z>>

In an amount of 10 kg of R-054 (Sanko Co., Ltd.) containing 85 weight % of Compound Z was mixed with 11.66 kg of MIBK and dissolved in the solvent at 80° C. for 1 hour in an atmosphere substituted with nitrogen. This solution was added with 25.52 kg of water, 12.76 kg of 20 weight % aqueous solution of MP polymer (MP-203, produced by Kuraray Co. Ltd.) and 0.44 kg of 20 weight % aqueous solution of sodium triisopropylnaphthalenesulfonate and subjected to emulsion dispersion at 20–40° C. and 3600 rpm for 60 minutes. The dispersion was further added with 0.08 kg of Safinol 104E (Nisshin Kagaku Co.) and 47.94 kg of water and distilled under reduced pressure to remove MIBK. Then, the concentration of Compound Z was adjusted to 10 weight %. The particles of Compound Z contained in the dispersion obtained as described above had a median diameter of 0.19 μm, maximum particle diameter of 1.5 μm or less and variation coefficient of 17% for particle diameter. The obtained dispersion was filtered through a polypropylene filter having a pore size of 3.0 μm to remove dusts and so forth and used for the preparation of the coating solution described below.

<<Preparation of Dispersion of 6-isopropylphthalazine Compound>>

In an amount of 62.35 g of water was added with 2.0 g of denatured polyvinyl alcohol (Poval MP203, produced by Kuraray Co., Ltd.) at room temperature with stirring so that the denatured polyvinyl alcohol should not coagulate, and mixed by stirring for 10 minutes. Then, the mixture was heated until the internal temperature reached 50° C., and stirred for 90 minutes at an internal temperature in the range of 50–60° C. to attain uniform dissolution. The internal temperature was lowered to 40° C. or lower, and the mixture was added with 25.5 g of 10 weight % aqueous solution of polyvinyl alcohol (PVA-217, produced by Kuraray Co., Ltd.), 3.0 g of 20 weight % aqueous solution of sodium triisopropylnaphthalenesulfonate and 7.15 g of 70% aqueous solution of 6-isopropylphthalazine and stirred for 30 minutes to obtain 100 g of transparent dispersion. The obtained dispersion was filtered through a polypropylene filter having a pore size of 3.0 μm to remove dusts and so forth, and used for the preparation of the coating solution described below.

<<Preparation of Solid Microparticle Dispersion of High Contrast Agent>>

In an amount of 4 kg of High contrast agent X-1 or X-2 was added with 1 kg of polyvinyl alcohol (Poval PVA-217, produced by Kuraray Co., Ltd.) and 36 kg of water, and mixed sufficiently to form slurry. The slurry was fed by a diaphragm pump to a bead mill of horizontal type (UVM-2, produced by Imex Co.) containing zirconia beads having a mean diameter of 0.5 mm, and dispersed for 12 hours. Then, the slurry was added with 4 g of benzoisothiazolinone sodium salt and water so that the concentration of the nucleating agent should become 10 weight % to obtain solid microparticle dispersion of High contrast agent X-1 or X-2. The particles of the nucleating agent contained in the dispersion obtained as described above had a median diameter of 0.34 μm, maximum particle diameter of 3.0 μm or less, and variation coefficient of 19% for the particle diameter. The obtained dispersion was filtered through a polypropylene filter having a pore size of 3.0 μm to remove dusts and so forth, and used for the preparation of the coating solution described below.

<<Preparation of Solid Microparticle Dispersion of Development Accelerator>>

In an amount of 10 kg of Development accelerator W-1 or W-2, 10 kg of 20 weight % aqueous solution of denatured polyvinyl alcohol (Poval MP203, produced by Kuraray Co., Ltd.) and 20 kg of water were added and mixed sufficiently to form slurry. The slurry was fed by a diaphragm pump to a bead mill of horizontal type (UVM-2, produced by Imex Co.) containing zirconia beads having a mean diameter of 0.5 mm, and dispersed for 5 hours. Then, the slurry was added with water so that the concentration of Development accelerator W-1 or W-2 should become 20 weight % to obtain a microparticle dispersion of Development accelerator W-1 or W-2. The particles of the development accelerator contained in the dispersion obtained as described above had a median diameter of 0.5 μm, maximum particle diameter of 2.0 μm or less, and variation coefficient of 18% for the mean particle diameter. The obtained dispersion was filtered through a polypropylene filter having a pore size of 3.0 μm to remove dusts and so forth, and used for the preparation of the coating solution described below.

<<Preparation of Coating Solution for Image-forming Layer>>

Silver behenate dispersion A prepared above was added with the following binder, components and silver halide emulsions in the indicated amounts per mole of silver in Silver behenate dispersion A, and added with water to prepare a coating solution for image-forming layer. After the completion, the solution was degassed under reduced pressure of 0.54 atm for 45 minutes. The coating solution showed pH of 7.7 and viscosity of 50 mPa.s at 25° C.

| | |
|---|---|
| Binder: SBR latex (St/Bu/AA = 68/29/3 (weight %), glass transition temperature: 17° C. (calculated value), $Na_2S_2O_8$ was used as polymerization initiator, pH was adjusted to 6.5 with $NH_4OH$, mean particle diameter: 118 nm) | 397 g as solid |
| 1,1-Bis (2-hydroxy-3,5-dimethylphenyl)-3,5,5-trimethylhexane | 149.5 g as solid |
| Organic polyhalogenated compound B | 36.3 g as solid |
| Organic polyhalogenated compound C | 2.34 g as solid |
| Sodium ethylthiosulfonate | 0.47 g |
| Benzotriazole | 1.02 g |
| Polyvinyl alcohol (PVA-235, produced by Kuraray Co., Ltd.) | 10.8 g |
| 6-Isopropylphthalazine | 12.8 g |
| Compound Z | 9.7 g as solid |
| Compound X-1 | 12.7 g |
| Dye A (added as a mixture with low molecular weight gelatin having mean molecular weight of 15,000) | Amount giving optical density of 0.3 at 783 nm (about 0.40 g as solid) |
| Silver halide emulsion A | 0.06 mole as Ag |
| Silver halide emulsion B | Amount shown in Table 1 |
| Compound A as preservative | 40 ppm in the coating solution (2.5 mg/m$^2$ as coated amount) |
| Methanol | 1 weight % as to total solvent amount in the coating solution |

-continued

| | |
|---|---|
| Ethanol | 2 weight % as to total solvent amount in the coating solution |

pH was adjusted by using NaOH as a pH adjusting agent.
(The coated film showed a glass transition temperature of 17° C.)

Polyhalogenated compound A

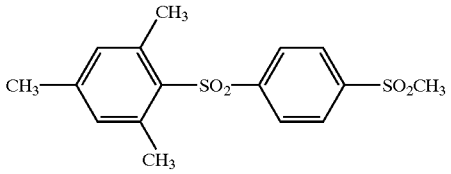

Polyhalogenated compound B

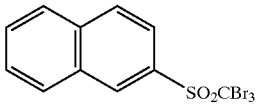

Compound Z

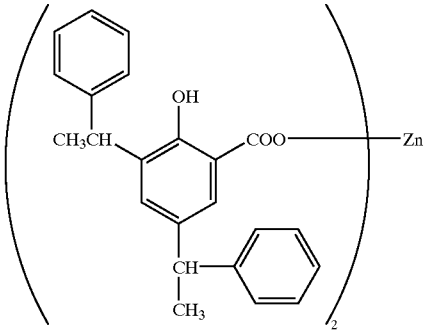

Polyhalogenated compound C

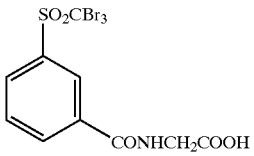

Dye A

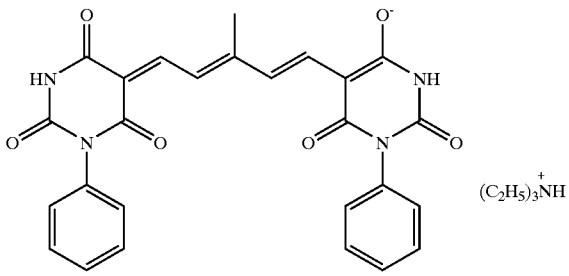

Development accelerator W-1

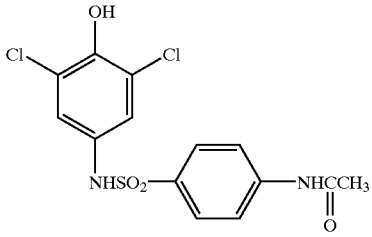

-continued

Compound X-1

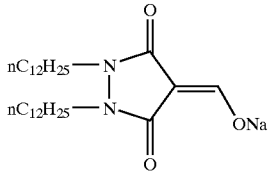

<<Preparation of Coating Solution for Protective Layer>>

In an amount of 943 g of a polymer latex solution of copolymer of methyl methacrylate/styrene/2-ethylhexyl acrylate/2-hydroxyethyl methacrylate/acrylic acid=58.9/8.6/25.4/5.1/2 (weight %) (glass transition temperature of copolymer: 46° C. (calculated value), solid content: 21.5 weight %, the solution contained 100 ppm of Compound A and further contained Compound D as a film-forming aid in an amount of 15 weight % relative to solid content of the latex so that the glass transition temperature of the coating solution should become 24° C., mean particle diameter: 116 nm) was added with water, 1.62 g of Compound E, 114.8 g of the aqueous solution of Organic polyhalogenated compound C, 17.0 g as solid content of Organic polyhalogenated compound A, 0.69 g as solid content of sodium dihydrogenorthophosphate dihydrate, 11.55 g as solid content of Development accelerator W-1, 1.58 g of matting agent (polystyrene particles, mean particle diameter: 7 μm, variation coefficient of 8% for mean particle diameter) and 29.3 g of polyvinyl alcohol (PVA-235, Kuraray Co., Ltd.), and further added with water to form a coating solution (containing 0.8 weight % of methanol solvent). After the preparation, the solution was degassed under reduced pressure of 0.47 atm for 60 minutes. The obtained coating solution for protective layer showed pH of 5.5 and viscosity of 45 mPa.s at 25° C.

<<Preparation of Coating Solution for Lower Overcoat Layer>>

In an amount of 625 g of a polymer latex solution of copolymer of methyl methacrylate/styrene/2-ethylhexyl acrylate/2-hydroxyethyl methacrylate/acrylic acid=58.9/8.6/25.4/5.1/2 (weight %) (glass transition temperature as copolymer: 46° C. (calculated value), solid content: 21.5 weight %, the solution contained 100 ppm of Compound A and further contained Compound D as a film-forming aid in an amount of 15 weight % relative to solid content of the latex so that the glass transition temperature of the coating solution should become 24° C., mean particle diameter: 74 nm) was added with water, 0.23 g of Compound C, 0.13 g of Compound E, 11.7 g of Compound F, 2.7 g of Compound H and 11.5 g of polyvinyl alcohol (PVA-235, Kuraray Co., Ltd.), and further added with water to form a coating solution (containing 0.1 weight % of methanol solvent). After the preparation, the solution was degassed under reduced pressure of 0.47 atm for 60 minutes. The obtained coating solution for lower overcoat layer showed pH of 2.6 and viscosity of 30 mPa.s at 25° C.

<<Preparation of Coating Solution for Upper Overcoat Layer>>

In an amount of 649 g of polymer latex solution of copolymer of methyl methacrylate/styrene/2-ethylhexyl acrylate/2-hydroxyethyl methacrylate/acrylic acid=58.9/8.6/25.4/5.1/2 (weight %) (glass transition temperature of the copolymer: 46° C. (calculated value), solid content: 21.5 weight %, the solution contained Compound A at a concentration of 100 ppm and further containing Compound D as a film-forming aid in an amount of 15 weight % relative to solid content of the latex so that the glass transition temperature of coating solution should become 24° C., mean particle diameter: 116 nm) was added with water, 18.4 g of 30 weight % solution of carnauba wax (Cellosol 524, Chukyo Yushi Co., Ltd., silicone content: less than 5 ppm), 0.23 g of Compound C, 1.85 g of Compound E, 1.0 g of Compound G, 3.45 g of matting agent (polystyrene particles, mean diameter: 7 μm, variation coefficient for mean particle diameter: 8%) and 26.5 g of polyvinyl alcohol (PVA-235, Kuraray Co., Ltd.) and further added with water to form a coating solution (containing 1.1 weight % of methanol solvent). After the preparation, the coating solution was degassed at a reduced pressure of 0.47 atm for 60 minutes. The obtained coating solution for upper overcoat layer showed pH of 5.3 and viscosity of 25 mPa.s at 25° C.

Compound C

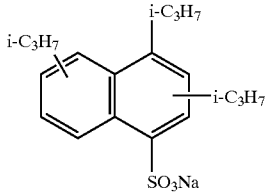

Compound D

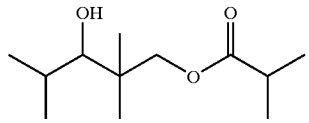

Compound E

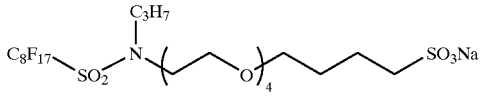

Compound F

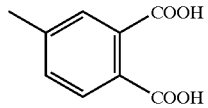

Compound G

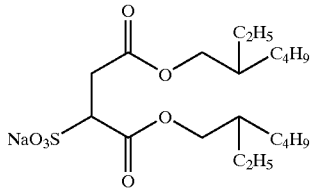

Compound H

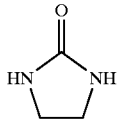

<<Preparation of Polyethylene Terephthalate (PET) Support with Back Layers and Undercoat Layers>>

(1) Preparation of PET Support

PET having IV (intrinsic viscosity) of 0.66 (measured in phenol/tetrachloroethane=6/4 (weight ratio) at 25° C.) was obtained in a conventional manner by using terephthalic acid and ethylene glycol. The product was pelletized, dried at 130° C. for 4 hours, then melted at 300° C., extruded from a T-die and rapidly cooled to form an unstretched film having such a thickness that the thickness should become 120 μm after thermal fixation.

The film was stretched along the longitudinal direction by 3.3 times at 110° C. using rollers of different peripheral speeds, and then stretched along the transverse direction by 4.5 times at 130° C. using a tenter. Then, the film was subjected to thermal fixation at 240° C. for 20 seconds, and relaxed by 4% along the transverse direction at the same temperature. Then, the chuck of the tenter was released, the both edges of the film were knurled, and the film was rolled up at 4.8 kg/cm$^2$. Thus, a roll of a PET support having a width of 2.4 m, length of 3500 m and thickness of 120 $\mu$m was obtained.

(2) Preparation of Undercoat Layers and Back Layers (i) First Undercoat Layer

The aforementioned PET support was subjected to a corona discharge treatment of 0.375 kV.A.minute/m$^2$, then coated with a coating solution having the following composition in an amount of 6.2 mL/m$^2$, and dried at 125° C. for 30 seconds, 150° C. for 30 seconds and 185° C. for 30 seconds.

| | |
|---|---|
| Latex A | 280 g |
| KOH | 0.5 g |
| Polystyrene microparticles (mean particle diameter: 2 $\mu$m, variation coefficient of 7% for mean particle diameter) | 0.03 g |
| 2,4-Dichloro-6-hydroxy-s-triazine | 1.8 g |
| Compound Bc-C | 0.097 g |
| Distilled water | Amount giving total weight of 1000 g |

(ii) Second Undercoat Layer

A coating solution having the following composition was coated on the first undercoat layer in an amount of 5.5 mL/m$^2$ and dried at 125° C. for 30 seconds, 150° C. for 30 seconds and 170° C. for 30 seconds.

| | |
|---|---|
| Deionized gelatin ($Ca^{2+}$ content: 0.6 ppm, jelly strength: 230 g) | 10 g |
| Acetic acid (20 weight % aqueous solution) | 10 g |
| Compound Bc-A | 0.04 g |
| Methyl cellulose (2 weight % aqueous solution) | 25 g |
| Polyethyleneoxy compound | 0.3 g |
| Distilled water | Amount giving total weight of 1000 g |

(iii) First Back Layer

The surface of the support opposite to the surface coated with the undercoat layers was subjected to a corona discharge treatment of 0.375 kV.A.minute/m$^2$, coated with a coating solution having the following composition in an amount of 13.8 mL/m$^2$, and dried at 125° C. for 30 seconds, 150° C. for 30 seconds and 185° C. for 30 seconds.

| | |
|---|---|
| Julimer ET-410 (30 weight % aqueous dispersion Nihon Junyaku Co., Ltd.) | 23 g |
| Alkali-treated gelatin (molecular weight: about 10,000, $Ca^{2+}$ content: 30 ppm) | 4.44 g |
| Deionized gelatin ($Ca^{2+}$ content: 0.6 ppm) | 0.84 g |
| Compound Bc-A | 0.02 g |

-continued

| | |
|---|---|
| Dye Bc-A | Amount giving optical density of 1.3–1.4 at 783 nm, about 0.88 g |
| Polyoxyethylene phenyl ether | 1.7 g |
| Water-soluble melamine compound (Sumitex Resin M-3, Sumitomo Chemical Co., Ltd., 8 weight % aqueous solution) | 15 g |
| Aqueous dispersion of Sb-doped $SbO_2$ acicular grains (FS-10D, Ishihara Sangyo Kaisha, Ltd.) | 24 g |
| Polystyrene microparticles (mean diameter: 2.0 $\mu$m, variation coefficient of 7% for mean particle diameter) | 0.03 g |
| Distilled water | Amount giving total weight of 1000 g |

(iv) Second Back Layer

A coating solution having the following composition was coated on the first back layer in an amount of 5.5 mL/m$^2$ and dried at 125° C. for 30 seconds, 150° C. for 30 seconds and 170° C. for 30 seconds.

| | |
|---|---|
| Julimer ET-410 (30 weight % aqueous dispersion Nihon Junyaku Co., Ltd.) | 57.5 g |
| Polyoxyethylene phenyl ether | 1.7 g |
| Water-soluble melamine compound (Sumitex Resin M-3, Sumitomo Chemical Co., Ltd., 8 weight % aqueous solution) | 15 g |
| Cellosol 524 (30 weight % aqueous solution, Chukyo Yushi Co., Ltd.) | 6.6 g |
| Distilled water | Amount giving total weight of 1000 g |

(v) Third Back Layer

The same coating solution as that for the first undercoat layer was coated on the second back layer in an amount of 6.2 mL/m$^2$ and dried at 125° C. for 30 seconds, 150° C. for 30 seconds and 185° C. for 30 seconds.

(vi) Fourth Back Layer

A coating solution having the following composition was coated on the third back layer in an amount of 13.8 mL/m$^2$ and dried at 125° C. for 30 seconds, 150° C. for 30 seconds and 170° C. for 30 seconds.

| | |
|---|---|
| Latex B | 286 g |
| Compound Bc-B | 2.7 g |
| Compound Bc-C | 0.6 g |
| Compound Bc-D | 0.5 g |
| 2,4-Dichloro-6-hydroxy-s-triazine | 2.5 g |
| Polymethyl methacrylate (10 weight % aqueous dispersion, mean particle diameter: 5 $\mu$m, variation coefficient of 7% for mean particle diameter) | 7.7 g |
| Distilled water | Amount giving total weight of 1000 g |

-continued

Dye Bc-A

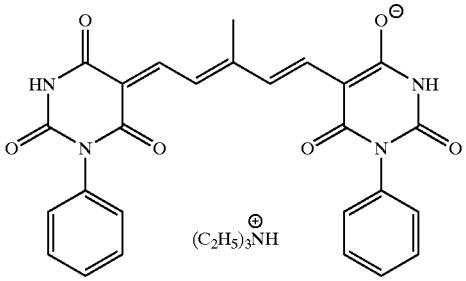

Compound Bc-A

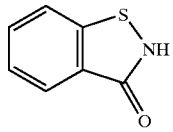

Compound Bc-B $C_{18}H_{17}OSO_3Na$

Compound Bc-C $C_8F_{17}SO_3Li$

Compound Bc-D $C_8H_{17}SO_2-N(C_4H_9)-(CH_2CH_2O)_4-(CH_2)_4-SO_3Na$

Latex A

Core/shell type latex comprising 90 weight % of core and 10 weight % of shell,

Core: copolymer of vinylidene chloride/methyl acrylate/methyl methacrylate/acrylonitrile/acrylic acid=93/3/3/0.9/0.1 (weight %), Shell: copolymer of vinylidene chloride/methyl acrylate/methyl methacrylate/acrylonitrile/acrylic acid=88/3/3/3/3 (weight %), Weight average molecular weight: 38000

Latex B

Latex of copolymer of methyl methacrylate/styrene/2-ethylhexyl acrylate/2-hydroxyethyl methacrylate/acrylic acid=59/9/26/5/1 (weight %)

(3) Heat Treatment During Transportation (3-1) Heat Treatment

The PET support with back layers and undercoat layers prepared as described above was introduced into a heat treatment zone having a total length of 200 m set at 160° C., and transported at a tension of 2 kg/cm$^2$ and a transportation speed of 20 m/minute.

(3-2) Post-heat Treatment

Following the aforementioned heat treatment, the support was subjected to a post-heat treatment by passing it through a zone at 40° C. for 15 seconds, and rolled up. The rolling up tension for this operation was 10 kg/cm$^2$.

<<Preparation of Photothermographic Material>>

On the second undercoat layer of the PET support, the aforementioned coating solution for image-forming layer was coated so that the coated silver amount should become 1.42 g/m$^2$ by the slide bead method disclosed in JP-A-2000-2964, FIG. 1. On the image-forming layer, the aforementioned coating solution for protective layer was coated simultaneously with the coating solution for image-forming layer as stacked layers so that the coated solid content of the polymer latex should become 1.29 g/m$^2$. Then, the aforementioned coating solution for lower overcoat layer and coating solution for upper overcoat layer were simultaneously coated on the protective layer as stacked layers, so that the coated solid contents of the polymer latex should become 1.97 g/m$^2$ and 1.07 g/m$^2$, respectively, to prepare a photothermographic material.

After the coating, the layers were dried in a horizontal drying zone (the support was at an angle of 1.5–3° to the horizontal direction of the coating machine) under the conditions of dew point of 14–25° C. and liquid film surface temperature of 35–40° C. for both of the constant rate drying process and the decreasing rate drying process until it reached around a drying point where flow of coating solutions substantially ceased. After the drying, the material was rolled up under the conditions of a temperature of 23±5° C. and relative humidity of 45±5%. The material was rolled up in such a rolled shape that the image-forming layer side should be toward the outside so as to conform to the subsequent processing (image-forming layer outside roll). The relative humidity in the package of the photothermographic material was 20–40% (measured at 25° C.). Each obtained photothermographic material showed a film surface pH of 5.0 and Beck's smoothness of 850 seconds for the image-forming layer side. The opposite surface showed a film surface pH of 5.9 and Beck's smoothness of 500 seconds. From each photothermographic material, a light-shielded photosensitive material roll was prepared as follows.

<<Preparation of Light-shielding Leader>>

Light shielding films (low density polyethylene sheets containing 5 weight % of carbon black and having a thickness of 30 μm) were adhered to both surfaces of a shrink film having a thickness of 30 μm (TNS, Gunze Ltd.) to prepare heat-shrinkable light-shielding film strips. The obtained heat-shrinkable light-shielding film strips showed heat shrinking ratios of 13.3% for the length direction and 11.9% for the width direction at 100° C., and Elmendorf tear load of 0.43 N along the length direction. These heat-shrinkable light-shielding film strips were adhered on both sides of a light-shielding sheet, consisting of a PET sheet having a thickness of 100 μm and low density polyethylene sheets containing 5 weight % of carbon black and having a thickness of 40 μm adhered on the both surfaces of the PET sheet, along the side ends so that the strips each should extend from the light-shielding sheet in the transverse direction to produce a light-shielding leader.

<<Production of Light-shielded Photosensitive Material Roll>>

The above light-shielding leader was adhered to an end of rolled photosensitive material with an adhesive tape, and disk-shaped light-shielding members were attached to the both ends of the light-sensitive material roll. Subsequently, the light-shielding leader of the rolled light-sensitive material was wound around the photosensitive material roll, while blowing the surfaces of the heat-shrinkable light-shielding film strips of the light-shielding leader with a hot wind at 270° C. so that the heat-shrinkable light-shielding film strips of the light-shielding leader should be contacted with the outside surfaces of the disk-shaped light-shielding members in a heat-shrunk state exceeding the outer peripheries thereof. Further, the end of the rolled light-shielding leader and the outside surface of light-shielding leader at a position corresponding to the previous round of winding were fixed with an adhesive, and then heaters at 130° C. were pressed against the surfaces of the heat-shrinkable light-shielding film strips adhered to the outside surfaces of the disk-shaped light-shielding members to fuse the outside surfaces of the disk-shaped light-shielding members and the heat-shrinkable light-shielding film strips. The roll had a width of 610 mm and the rolled light sensitive material had a length of 59 m.

The following performance evaluation was performed for the samples prepared as described above.

<<Light Exposure>>

Each photothermographic material was light exposed at a mirror revolution number of 64000 rpm and a main scanning speed of 633 m/second in a laser plotter of single channel cylindrical internal surface scanning type provided with a semiconductor laser with a beam diameter (½ of FWHM of beam intensity) of 12.56 $\mu$m, laser output of 50 mW and output wavelength of 780 nm. The overlap coefficient of the light exposure was 0.449, and the laser energy density on the photothermographic material surface was 70 $\mu J/cm^2$.

<<Heat Development>>

The photothermographic material was transported from the aforementioned plotter by an auto carrier and heat-developed in such a heat development apparatus as shown in FIG. 1 in an on-line manner. The roller surface material of the heat development section was composed of silicone rubber, and the flat surface consisted of Teflon non-woven fabric. The transportation line speed in the heat development section was 25 mm/second. The heat development was performed for 12.2 seconds in the preheating section (driving units of the preheating section and the heat development section were independent from each other, speed difference as to the heat development section was adjusted to −0.5% to −1%, speed difference as to the auto carrier was adjusted to 0% to −1.0%, and temperatures and processing times for each of the metallic rollers in the preheating section were as follows: first roller, 67° C. for 2.0 seconds; second roller, 82° C. for 2.0 seconds; third roller, 98° C. for 2.0 seconds; fourth roller, 107° C. for 2.0 seconds; fifth roller, 115° C. for 2.0 seconds; and sixth roller, 120° C. for 2.0 seconds), for 17.2 seconds at 120° C. (surface temperature of photothermographic material) in the heat development section, and for 13.6 seconds in the gradual cooling section. The temperature precision as for the transverse direction was ±0.5° C. As for temperature setting of each roller, the temperature precision was secured by using a length of rollers longer than the width of the photothermographic material (for example, width of 61 cm) by 5 cm for the both sides and also heating the protruding portions. Since the rollers showed marked temperature decrease at the both end portions, the temperature of the portions protruding by 5 cm from the ends of the photothermographic material was controlled to be higher than that of the roller center by 1–3° C., so that uniform image density of finished developed image should be obtained for the whole photothermographic material (for example, within a width of 61 cm).

<<Evaluation of Photographic Performance>>

The obtained images were evaluated by using Macbeth TD904 densitometer (visible density). The measurement results were evaluated as Dmin (fog), Dmax (maximum density), sensitivity (evaluated as relative value of reciprocal of a ratio of exposure giving a density higher by 1.5 than Dmin, and the sensitivity value of Photothermographic material 1 was taken as 100) and gradation (: gradient of a straight line connecting the points at densities higher by 0.3 and 3 than Dmin on characteristic curbe). Further, each prepared sample was stored at 50° C. for 5 days in the rolled shape, then similarly exposed and heat-developed, and its Dmin was evaluated.

The results of the aforementioned evaluations of the photothermographic materials are shown in Table 1.

TABLE 1

| | Silver halide emulsion A | Silver halide emulsion B | | | | | Storability before | |
|---|---|---|---|---|---|---|---|---|
| | Halogen | Halogen | Amount | Photographic performance | | | development | |
| Sample | composition | composition | (as Ag) | Dmin | Sensitivity | Gradation | Dmin | Note |
| 1 | AgBr | — | — | 0.12 | 100 | 19 | 0.25 | Comparative |
| 2 | AgBr | AgI | 0.015 | 0.12 | 102 | 19 | 0.14 | Invention |
| 3 | AgBr | AgI | 0.03 | 0.12 | 100 | 20 | 0.13 | Invention |
| 4 | AgBr | AgI | 0.06 | 0.11 | 98 | 22 | 0.12 | Invention |
| 5 | AgBr | $AgBr_{70}I_{30}$ | 0.05 | 0.12 | 105 | 20 | 0.15 | Invention |
| 6 | AgBr | $AgBr_{70}I_{30}$ | 0.1 | 0.13 | 106 | 20 | 0.14 | Invention |
| 7 | AgBr | $AgBr_{90}I_{10}$ | 0.15 | 0.14 | 108 | 20 | 0.16 | Invention |
| 8 | AgBr | $AgBr_{95}I_5$ | 0.3 | 0.20 | 125 | 19 | 0.35 | Comparative |
| 9 | AgBr | AgBr | 0.15 | 0.17 | 125 | 19 | 0.35 | Comparative |
| 10 | AgBr | AgBr | 0.3 | 0.20 | 130 | 19 | 0.40 | Comparative |
| 11 | $AgBr_{95}I_5$ | — | — | 0.12 | 90 | 20 | 0.24 | Comparative |
| 12 | $AgBr_{95}I_5$ | AgI | 0.015 | 0.12 | 95 | 21 | 0.14 | Invention |
| 13 | $AgBr_{95}I_5$ | AgI | 0.03 | 0.11 | 93 | 22 | 0.12 | Invention |
| 14 | $AgBr_{95}I_5$ | AgI | 0.06 | 0.11 | 90 | 21 | 0.12 | Invention |
| 15 | $AgBr_{90}I_{10}$ | — | — | 0.11 | 50 | 20 | 0.23 | Comparative |
| 16 | $AgBr_{90}I_{10}$ | AgI | 0.015 | 0.11 | 52 | 20 | 0.12 | Comparative |
| 17 | $AgBr_{90}I_{10}$ | AgI | 0.03 | 0.11 | 50 | 20 | 0.12 | Comparative |
| 18 | AgI | — | — | 0.11 | No image | — | 0.11 | Comparative |

As clearly seen from the results shown in Table 1, the photothermographic materials of the present invention favorably showed high contrast, high Dmax and superior storability before development.

<Example 2>

The samples used in Example 1 were exposed and heat-developed in a heat development system comprising an A2 size plotter, FT-286R, produced by NEC Corp., a dry system auto carrier, FDS-C1000, produced by Fuji Photo Film Co., Ltd., and a dry film processor, FDS-6100X, produced by Fuji Photo Film Co., Ltd. As a result, the photothermographic materials of the present invention showed high contrast, high Dmax and superior storability before development as in Example 1.

<Example 3>

<<Preparation of Coating Solution for Image-forming Layer>>

Silver behenate dispersion A prepared in Example 1 was added with the following binder, components and Silver halide emulsion A in the indicated amounts per mole of silver in Silver behenate dispersion A, and added with water to prepare a coating solution for image-forming layer. After the preparation, the solution was degassed under reduced pressure of 0.54 atm for 45 minutes. The coating solution showed pH of 7.3–7.7 and viscosity of 40–50 mPa.s at 25° C.

| | |
|---|---|
| Binder: SBR latex (St/Bu/AA = 68/29/3 (weight %), glass transition temperature: 17° C. (calculated value), $Na_2S_2O_8$ was used as polymerization initiator, pH was adjusted to 6.5 with NaOH, mean particle diameter: 118 nm) | 397 g as solid |
| 1,1-Bis(2-hydroxy-3,5-dimethyl-phenyl)-3,5,5-trimethylhexane | 118.2 g as solid |
| Organic polyhalogenated compound A | 20.0 g as solid |
| Organic polyhalogenated compound B | 6.0 g as solid |
| Organic polyhalogenated compound C | 2.0 g as solid |
| Organic polyhalogenated compound D | 34.4 g as solid |
| Development accelerator W-2 | 11.5 g as solid |
| Sodium ethylthiosulfonate | 0.3 g |
| Benzotriazole | 1.2 g |
| Polyvinyl alcohol (PVA-235, produced by Kuraray Co., Ltd.) | 10.8 g |
| 6-Isopropylphthalazine | 14.0 g |
| Compound Z | 9.6 g as solid |
| Compound C | 0.2 g |
| High contrast agent X-2 | 8.9 g |
| Dye A (added as a mixture with low molecular weight gelatin having mean molecular weight of 15,000) | Amount giving optical density of 0.3 at 783 nm (about 0.40 g as solid) |
| Silver halide emulsion A | 0.06 mole as Ag |
| Compound A as preservative | 40 ppm in the coating solution (2.5 mg/m$^2$ as coated amount) |
| Methanol | 1 weight % as to total solvent amount in the coating solution |
| Ethanol | 2 weight % as to total solvent amount in the coating solution |

NaOH was used as a pH adjusting agent.

(The coated film showed a glass transition temperature of 17° C.)

<<Preparation of Solid Microparticle Dispersion of Organic Polyhalogenated Compound D>>

In an amount of 6 kg of Organic polyhalogenated compound D, 12 kg of 10 weight % aqueous solution of denatured polyvinyl alcohol (Poval MP203, produced by Kuraray Co. Ltd.), 240 g of 20 weight % aqueous solution of sodium triisopropylnaphthalenesulfonate and 0.18 kg of water were mixed sufficiently to form slurry. The slurry was fed by a diaphragm pump to a bead mill of horizontal type (UVM-2, produced by Imex Co.) containing zirconia beads having a mean diameter of 0.5 mm, and dispersed for 5 hours. Then, the slurry was added with 2 g of benzoisothiazolinone sodium salt and water so that the concentration of Organic polyhalogenated compound D should become 30 weight % to obtain solid microparticle dispersion of Organic polyhalogenated compound D. The particles of the organic polyhalogenated compound contained in the obtained dispersion had a median diameter of 0.40 μm, maximum particle diameter of 2.0 μm or less and variation coefficient of 20% for mean particle diameter. The obtained dispersion was filtered through a polypropylene filter having a pore size of 3.0 μm to remove dusts and so forth, and used for the preparation of the coating solution described above.

Organic polyhalogenated compound D

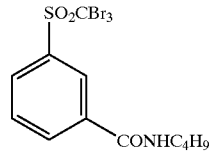

Development accelerator W-2

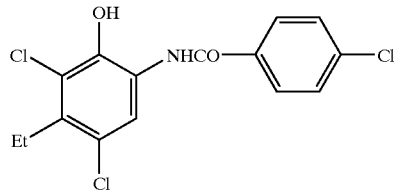

High contrast agent X-2

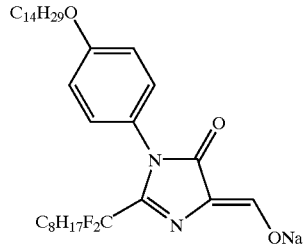

<<Preparation of Coating Solution for Lower Protective Layer>>

In an amount of 900 g of a polymer latex solution containing copolymer of methyl acrylate/methyl methacrylate=70/30 (weight ratio, mean particle diameter: 110 nm, weight average molecular weight: 800,000, glass transition temperature of copolymer: 30° C., solid content: 28.0 weight %, containing 100 ppm of Compound A) was added with water, 0.2 g of Compound E and 35.0 g of polyvinyl alcohol (PVA-235, Kuraray Co., Ltd.) and further added with water to form a coating solution (containing 0.5 weight % of methanol solvent). After the preparation, the solution was degassed under reduced pressure of 0.47 atm for 60 minutes. The coating solution showed pH of 5.2 and viscosity of 35 mPa.s at 25° C.

<<Preparation of Coating Solution for Upper Protective Layer>>

In an amount of 900 g of a polymer latex solution containing copolymer of methyl acrylate/methyl methacrylate=70/30 (weight ratio, mean particle diameter: 110 nm, weight average molecular weight: 800,000, glass transition temperature of copolymer: 30° C., solid content: 28.0 weight %, containing 100 ppm of Compound A) was added with 10.0 g of 30 weight % solution of carnauba wax (Cellosol 524, silicone content: less than 5 ppm, Chukyo Yushi Co., Ltd.), 0.3 g of Compound C, 1.2 g of Compound E, 25.0 g of Compound F, 6.0 g of Compound H, 7 g of matting agent (polystyrene particles, mean particle diameter: 9 μm, variation coefficient of 8% for mean particle diameter) and 40.0 g of polyvinyl alcohol (PVA-235, Kuraray Co., Ltd.), and further added with water to form a coating solution (containing 1.5 weight % of methanol solvent). After the preparation, the solution was degassed under reduced pressure of 0.47 atm for 60 minutes. The coating solution showed pH of 2.4 and viscosity of 35 mPa.s at 25° C.

<<Preparation of Photothermographic Material>>

On undercoat layers of a PET support coated with the undercoat layers as described in Example 1, the aforementioned coating solution for image-forming layer, coating solution for lower protective layer and coating solution for upper protective layer were simultaneously coated as stacked layers in this order from the support by the slide bead method disclosed in JP-A-2000-2964, FIG. 1, so that the coated silver amount in the image-forming layer should become 1.5 g/m$^2$, the coated solid content of the polymer latex in the lower protective layer should become 1.0 g/m$^2$, and the coated solid content of the polymer latex in the upper protective layer should become 1.3 g/m$^2$.

As for drying conditions after the coating, the layers were dried in a first drying zone (low wind velocity drying region) at a dry-bulb temperature of 70–75° C., dew point of 9–23° C., wind velocity of 8–10 m/second at the support surface and liquid film surface temperature of 35–40° C., and in a second drying zone (high wind velocity drying region) at a dry-bulb temperature of 65–70° C., dew point of 20–23° C. and wind velocity of 20–25 m/second at the support surface. The drying was performed with a residence time in the first drying zone corresponding to ⅔ of the period of the constant ratio drying in this zone, and thereafter the material was transferred to the second drying zone and dried. The first drying zone was a horizontal drying zone (the support was at an angle of 1.5–3° to the horizontal direction of the coating machine). The coating speed was 60 m/minute. After the drying, the material was rolled up under the conditions of a temperature of 25±5° C. and relative humidity of 45±10%. The material was rolled up in such a rolled shape that the image-forming layer side should be toward the outside so as to conform to the subsequent processing (image-forming layer outside roll). The humidity in the package of the photothermographic material was 20–40% of relative humidity (measured at 25° C.). The obtained photothermographic material showed a film surface pH of 5.0 and Beck's smoothness of 1800 seconds for the image-forming layer side. The opposite surface showed a film surface pH of 5.9 and Beck's smoothness of 500 seconds.

From each photothermographic material, a light-shielded photosensitive material similar to those of Example 1 was produced and examined for photographic properties. As a result, the samples having the characteristics of the present invention showed good storability before development and good performance as in Example 1.

<Example 4>

Samples were prepared in the same manner as in Examples 1 and 3 except that the base described below was used instead of the base used in Examples 1 and 3, and subjected to heat development in the same manner as in Example 1. As a result, the photothermographic materials of the present invention substantially reproduced the results obtained in Examples 1 and 3, and thus the advantages of the present invention were clearly demonstrated.

<<Preparation of Polyethylene Terephthalate (PET) Support with Back Layers and Undercoat Layers>>

(1) Preparation of PET Support

Polyethylene terephthalate having IV (intrinsic viscosity) of 0.66 (measured in phenol/tetrachloroethane=6/4 (weight ratio) at 25° C.) was obtained in a conventional manner by using terephthalic acid and ethylene glycol. The product was pelletized, dried at 130° C. for 4 hours, melted at 300° C., then extruded from a T-die and rapidly cooled to form an unstretched film having such a thickness that the thickness should become 120 μm after thermal fixation.

The film was stretched along the longitudinal direction by 3.3 times using rollers of different peripheral speeds, and then stretched along the transverse direction by 4.5 times using a tenter. These operations were performed at temperatures of 110° C. and 130° C., respectively. Then, the film was subjected to thermal fixation at 240° C. for 20 seconds, and relaxed by 4% along the transverse direction at the same temperature. Then, the chuck of the tenter was released, the both edges of the film were knurled, and the film was rolled up at 4.8 kg/cm$^2$. Thus, a roll of a PET support having a width of 1.4 m, length of 3500 m, and thickness of 120 μm was obtained.

(2) Preparation of Undercoat Layers and Back Layers

Coating solutions S-A to S-C were prepared, and Coating solutions S-C and S-A were coated on the image-forming layer coating side of the support in that order from the support in amounts of 13.8 ml/m$^2$ and 6.2 ml/m$^2$, respectively. Further, Coating solutions S-A and S-B were coated on the back layer coating side in that order from the support in amounts of 6.2 ml/m$^2$ and 13.8 ml/m$^2$, respectively. The coated layers were dried at 125° C. for 30 seconds, 150° C. for 30 seconds and 185° C. for 30 seconds. Both surfaces of the PET support were subjected to a corona discharge treatment of 0.375 kV.A.minute/m$^2$.

| | |
|---|---|
| (i) Coating solution S-A | |
| Latex A | 280 g |
| KOH | 0.5 g |
| Polystyrene microparticles (mean particle diameter: 2 μm, variation coefficient of 7% for mean particle diameter) | 0.03 g |
| 2,4-Dichloro-6-hydroxy-s-triazine | 1.8 g |
| Compound Bc-C | 0.06 g |
| Distilled water | Amount giving total weight of 1000 g |
| (ii) Coating solution S-C | |
| Pesresin A520 (30 weight % aqueous dispersion Takamatsu Yushi Co., Ltd.) | 46 g |
| Alkali-treated gelatin (molecular weight: about 10000, $Ca^{2+}$ content: 30 ppm) | 4.44 g |
| Deionized gelatin ($Ca^{2+}$ content: 0.6 ppm) | 0.84 g |
| Compound Bc-A | 0.02 g |
| Dye Bc-A | Amount giving optical density of 1.3 at 783 nm, |
| Polyoxyethylene phenyl ether | 1.7 g |
| Water-soluble melamine compound (Sumitex Resin M-3, Sumitomo Chemical Co., Ltd., 8 weight % aqueous solution) | 15 g |
| Aqueous dispersion of Sb-doped $SbO_2$ acicular grains (FS-10D, Ishihara Sangyo Kaisha, Ltd.) | 81.5 g |

-continued

| | |
|---|---|
| Polystyrene microparticles (mean diameter: 2.0 μm, variation coefficient of 7% for mean particle diameter) | 0.03 g |
| Distilled water | Amount giving total weight of 1000 g |
| (iii) Coating solution S-B | |
| Chemipearl S120 (27 weight % aqueous dispersion Mitsui Chemical Co., Ltd.) | 73.1 g |
| Pesresin A615G (25 weight % aqueous dispersion Takamatsu Yushi Co., Ltd.) | 78.9 g |
| Compound Bc-B | 2.7 g |
| Compound Bc-C | 0.3 g |
| Compound Bc-D | 0.25 g |
| Water-soluble epoxy compound (Denacol EX-521, Nagase Kasei Co., Ltd.) | 3.4 mg/m$^2$ |
| Polymethyl methacrylate (10 weight % aqueous dispersion, mean particle diameter: 5.0 μm, variation coefficient of 7% for mean particle diameter) | 7.7 g |
| Distilled water | Amount giving total weight of 1000 g |

(3) Heat Treatment During Transportation (3-1) Heat Treatment

The PET support with back layers and undercoat layers prepared as described above was introduced into a heat treatment zone having a total length of 200 m set at 160° C., and transported at a tension of 2 kg/cm$^2$ and a transportation speed of 20 m/minute.

(3-2) Post-heat Treatment

Following the aforementioned heat treatment, the support was subjected to a post-heat treatment by passing it through a zone at 40° C. for 15 seconds, and rolled up. The rolling up tension for this operation was 10 kg/cm$^2$.

<Example 5>

1) Preparation of Undercoated Polyethylene Terephthalate Support

<<Preparation of Polyethylene Terephthalate Support>>

Polyethylene terephthalate (henceforth abbreviated as "PET") pellets were dried at 130° C. for 4 hours, melted at 300° C., then extruded from a T-die and rapidly cooled to form an unstretched film. The film was stretched along the longitudinal direction by 3.0 times using rollers of different peripheral speeds, and then stretched along the transverse direction by 4.5 times using a tenter. The temperatures used for these operations were 110° C. and 130° C., respectively. Then, the film was subjected to thermal fixation at 240° C. for 20 seconds, and relaxed by 4% along the transverse direction at the same temperature. Thereafter, the film was subjected to a heat treatment by passing it through a zone at 200° C. at a speed of 20 m/min over 10 minutes with a rolling up tension of 3.5 kg/cm$^2$.

Subsequently, the chuck of the tenter was released, the both edges of the film were knurled, and the film was rolled up with a force of 40 N. Thus, a roll of a PET film having a width of 2.4 m, length of 800 m and thickness of 130 μm was obtained. The PET film showed a glass transition temperature of 79° C.

The both surfaces of the biaxially stretched and thermally fixed PET support having a thickness of 130 μm, which was prepared as described above, was subjected to a corona discharge treatment of 8 W/m$^2$.minute. On one surface of the support, Undercoat coating solution a-1 mentioned below was coated in such an amount that a dry film thickness of 0.8 μm should be obtained and dried to form Undercoat layer A-1, and on the opposite surface, Undercoat coating solution b-1 mentioned below containing an antistatic component was applied in such an amount that a dry film thickness of 0.8 μm should be obtained and dried to form Undercoat layer B-1 having antistatic property.

| | |
|---|---|
| <<Undercoat coating solution a-1>> | |
| Copolymer latex solution (solid content: 30%, butyl acrylate/tert-butyl acrylate/styrene/2-hydroxyethyl acrylate = 30/20/25/25 (weight %)) | 270 g |
| (C-1) | 0.6 g |
| Hexamethylene-1,6-bis(ethyleneurea) | 0.8 g |
| Polystyrene microparticles (mean particle size: 3 μm) | 0.05 g |
| Colloidal silica (mean particle size: 90 μm) | 0.1 g |
| Water | Amount giving a total volume of 1000 mL |
| <<Undercoat coating solution b-1>> | |
| $SnO_2$/Sb (weight ratio: 9/1, mean particle size: 0.18 μm) | Amount giving coating amount of 200 mg/m$^2$ |
| Copolymer latex solution (solid content: 30%, butyl acrylate/styrene/glycidyl acrylate = 30/20/40 (weight %) | 270 g |
| (C-1) | 0.6 g |
| Hexamethylene-1,6-bis (ethyleneurea) | 0.8 g |
| Water | Amount giving a total volume of 1000 mL |

The upper surfaces of Undercoat layer A-1 and Undercoat layer B-1 were subjected to a corona discharge treatment of 8 W/m$^2$.minute. On Undercoat layer A-1, Upper undercoat coating solution a-2 mentioned below was coated to form Upper undercoat layer A-2 having a dry film thickness of 0.1 μm, and on Undercoat layer B-1, Upper undercoat coating solution b-2 mentioned below was applied to form Upper undercoat layer B-2 having a dry film thickness of 0.8 μm and antistatic property.

| | |
|---|---|
| <<Upper undercoat coating solution a-2>> | |
| Gelatin | Amount giving coated amount of 0.4 g/m2 |
| (C-1) | 0.2 g |
| (C-3) | 0.1 g |
| Silica particles (mean particle size: 3 μm) | 0.1 g |
| Water | Amount giving a total volume of 1000 mL |
| <<Upper undercoat coating solution b-2>> | |
| (C-4) | 60 g |
| Latex solution containing (C-5) (solid content: 20%) | 80 g |
| Ammonium sulfate | 0.5 g |
| (C-6) | 12 g |
| Polyethylene glycol (weight average molecular weight: 600) | 6 g |
| Water | Amount giving a total volume of 1000 mL |

-continued (C-1)

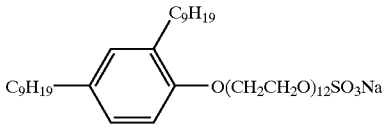

(C-2)

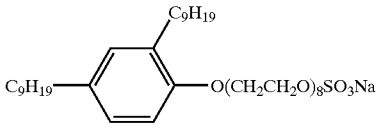

(C-3)

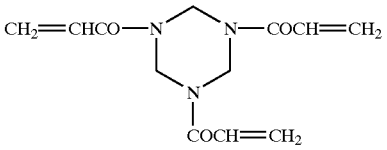

(C-4)

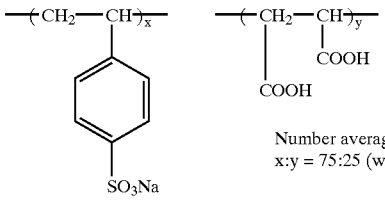

Number average MW: 5,000
x:y = 75:25 (weight ratio)

(C-5)

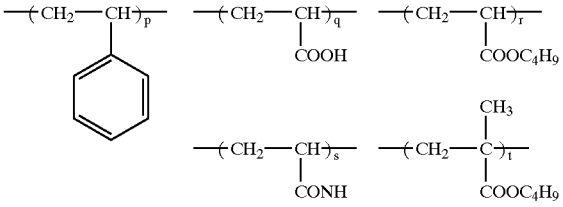

p:q:r:s:t = 40:5:10:5:40 (weight ratio)

(C-6)

Mixture of the following compounds

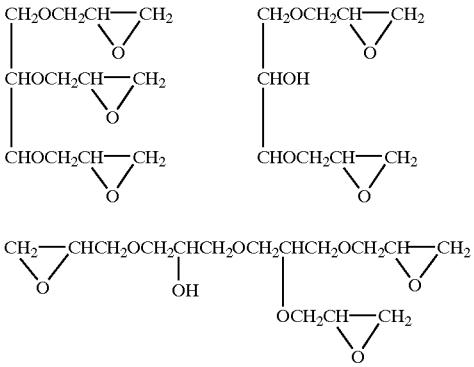

<<Heat Treatment of Support>>

The aforementioned undercoated support was heated to 150° C. during the drying process for undercoat layers and then gradually cooled. The rolling up tension was 3.6 kg/cm$^2$.

2) Preparation of Emulsions and Solutions

<<Preparation of Silver Halide Emulsion>>

In an amount of 7.5 g of inert gelatin and 10 mg of potassium bromide were dissolved in 900 mL of water, and the solution was adjusted to a temperature of 35° C. and pH 3.0, and added with 370 mL of an aqueous solution containing 74 g of silver nitrate and 370 mL of an aqueous solution containing sodium chloride, potassium bromide, potassium iodide in a molar ratio of 60/38/2, $[Ir(NO)Cl_5]$ salt in an amount of $1\times10^{-6}$ mole per mole of silver and rhodium chloride salt in an amount of $1\times10^{-6}$ mole per mole of silver by the controlled double jet method, while the pAg was kept at 7.7. Then, the solution was added with 4-hydroxy-6-methyl-1,3,3a,7-tetrazaindene and adjusted to pH 8.0 with NaOH and pAg 6.5 to perform reduction sensitization. Thus, cubic silver chloroiodobromide grains having a mean grain size of 0.06 $\mu$m, monodispersion degree of 10%, variation coefficient of 8% for diameter of projected area as circle and [100] face ratio of 87%. This emulsion was added with a gelatin coagulant to cause coagulation precipitation for desalting, then added with 0.1 g of phenoxyethanol and adjusted to pH 5.9 and pAg 7.5 to obtain a silver halide emulsion.

<<Preparation of Sodium Behenate Solution>>

In an amount of 32.4 g of behenic acid, 9.9 g of arachidic acid and 5.6 g of stearic acid were dissolved in 945 mL of pure water at 90° C. Then, the solution was added with 98 mL of 1.5 mol/L sodium hydroxide aqueous solution with stirring at high speed. Subsequently, the solution was added with 0.93 mL of concentrated nitric acid, cooled to 55° C. and stirred for 30 minutes to obtain a sodium behenate solution.

<<Preparation of Preform Emulsion of Silver Behenate and Silver Halide Emulsion>>

The aforementioned sodium behenate solution was added with the silver halide emulsion mentioned above and the pure silver iodide emulsion prepared in Example 1 (Silver halide emulsion B), adjusted to pH 8.1 with a sodium hydroxide solution, then added with 147 mL of 1 mol/L silver nitrate solution over 7 minutes, and stirred for 20 minutes, and water-soluble salts were removed by ultrafiltration. The produced silver behenate was in the form of grains having a mean grain size of 0.8 $\mu$m and monodispersion degree of 8%. After flocculates of the dispersion was formed, water was removed and the residue was subjected to 6 times of washing with water and removal of water and dried to obtain a preform emulsion.

<<Preparation of Photosensitive Emulsion>>

The aforementioned preform emulsion was divided into portions and gradually added with 544 g of a solution of polyvinyl butyral (average molecular weight: 3,000) in methyl ethyl ketone (17 weight %) and 107 g of toluene, mixed and then dispersed at 30° C. for 10 minutes in a media dispersing machine utilizing a bead mill containing $ZrO_2$ having a size of 0.5 mm at 4000 psi to prepare a photosensitive emulsion. After the dispersion, the organic silver grains were examined by electron microphotography. As a result of measurement of grain size and thickness of 300 organic silver grains, it was found that 205 or more of the grains were monodispersed tabular organic silver grains having AR of 3 or more and monodispersion degree of 25%. The mean grain size was 0.7 $\mu$m. Moreover, the organic silver grains were examined also after coating and drying, and the same grains could be confirmed.

The both surfaces of the aforementioned support were simultaneously coated with the following layers to prepare Sample 1 not containing Silver halide emulsion B and Sample 2 containing Silver halide emulsion B. Each layer was dried at 60° C. for 15 minutes.

3) Coating of Back Surface Side

The coating solution for back layer mentioned below was applied on Undercoat layer B-2 of the support.

| <<Coating solution for back layer>> | |
|---|---|
| Cellulose acetate butyrate (10% solution in methyl ethyl ketone) | 15 mL/m$^2$ |
| Dye A | 60 mg/m$^2$ |
| Matting agent (monodispersed silica, monodispersion degree: 9%, mean particle size: 8 $\mu$m) | 90 mg/m$^2$ |

-continued

| | |
|---|---|
| $C_8F_{17}$ $(CH_2CH_2O)_{12}C_8F_{17}$ | 50 mg/m$^2$ |
| $C_9F_{19}$—$C_6H_4$—$SO_3Na$ | 10 mg/m$^2$ |

4) Coating of Image-forming Layer Surface Side

The coating solution for image-forming layer and coating solution for surface protective layer mentioned below were simultaneously coated as stacked layers on Undercoat layer A-1 of the support. The surface protective layer was formed on the image-forming layer. The coating was performed so that the coated silver amount in the image-forming layer should become 1.5 g/m$^2$.

| <<Coating solution for image-forming layer | |
|---|---|
| Photosensitive emulsion mentioned above | 240 g |
| Sensitizing dye (0.1% methanol solution) | 1.7 mL |
| Pyridinium perbromide (6% methanol solution) | 3 mL |
| Calcium bromide (0.1% methanol solution) | 1.7 mL |
| Oxidizing agent (10% methanol solution) | 1.2 mL |
| Anitifoggant | 1.0 g |
| 2-Mercaptobenzimidazole (1% methanol solution) | 11 mL |
| Ttribromomethylsulfoquinoline (5% methanol solution) | 8 mL |
| Ttribromomethylsulfopyridine (5% methanol solution) | 9 mL |
| High contrast agent | 0.4 g |
| Hydrazine 1 | 0.6 g |
| 4-Methylphthalic acid | 0.25 g |
| Tetrachlorophthalic acid | 0.2 g |
| Calcium carbonate (mean particle size: 3 $\mu$m) | 0.1 g |
| Isocyanate compound (Desmodur N3300) | 0.5 g |
| 1,1-Bis(2-hydroxy-3,5-dimethylphenyl)-2-methylpropane (20% methanol solution) | 5.0 mL |
| 1,1-Bis(2-hydroxy-3,5-dimethylphenyl) -3,5,5-trimethylhexane (20% methanol solution) | 16.0 mL |
| <<Coating solution for surface protective layer>> | |
| Acetone | 5 mL/m$^2$ |
| Methyl ethyl ketone | 21 mL/m$^2$ |
| Cellulose acetate butyrate | 2.3 g/m$^2$ |
| Methanol | 7 mL/m$^2$ |
| Phthalazine | 250 mg/m$^2$ |
| Matting agent (monodispersed silica, monodispersion degree: 10%, mean grain size: 4 $\mu$m) | 5 mg/m$^2$ |
| $CH_2$=$CHSO_2CH_2CONHCH_2CH_2NHCOCH_2SO_2CH$=$CH_2$ | 35 mg/m$^2$ |
| Fluorine-containing surfactants | |
| $C_{12}F_{25}(CH_2CH_2O)_{10}C_{12}F_{25}$ | 10 mg/m$^2$ |
| $C_8F_{17}$—$C_6H_4$—$SO_3Na$ | 10 mg/m$^2$ |

Sensitizing dye

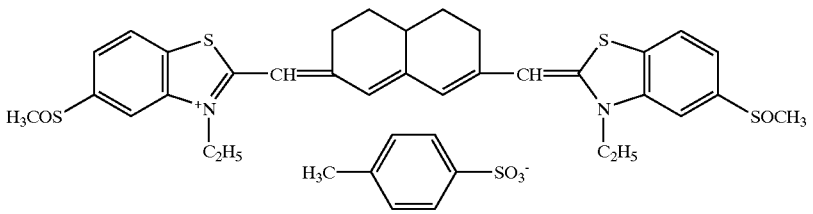

-continued

Oxidizing agent

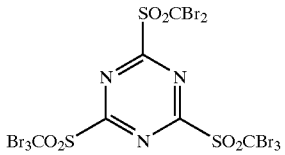

Dye A

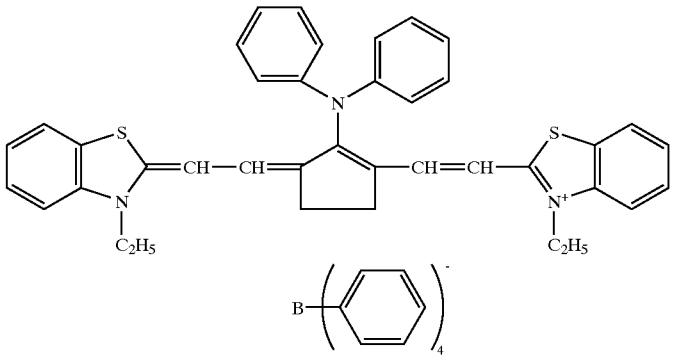

Antifoggant

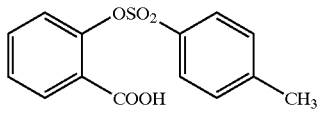

High contrast agent

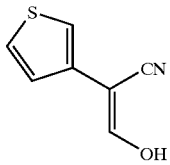

Hydrazine 1

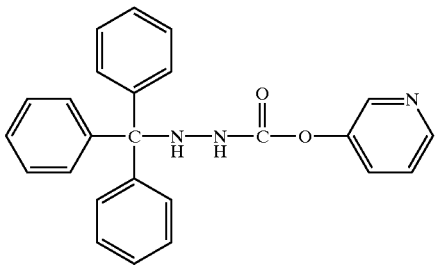

Samples were prepared by a different coating method. The samples showed Beck's smoothness of 1700 seconds for the image-forming layer side and 150 seconds for the opposite side. The samples were evaluated in the same manner as in Example 1. As a result, the samples having the characteristics of the present invention showed good performance.

What is claimed is:

1. A photothermographic material containing a silver salt of an organic acid, a silver halide and a reducing agent on a transparent support, which has two or more maximum values of silver content in silver iodide content distribution of total silver halide grains contained in the photothermographic material plotted with silver iodide content in abscissa and silver content in silver halide grains in ordinate, wherein at least one maximum value is in a silver iodide content range of less than 10 mol % and at least one maximum value is in a silver iodide content range of 10 mol % or more.

2. The photothermographic material according to claim 1, which satisfies the requirement defined by the following equation:

$$\frac{\text{total amount of silver contained in silver halide having silver iodide content of less than 10 mol \%}}{\text{total amount of silver contained in silver halide having silver iodide content of 10 mol \% or more}} \times 100 \geqq \text{average silver iodide content of silver halide having silver iodide content of 10 mol \% or more.}$$

3. The photothermographic material according to claim 1, wherein the silver halide having a silver iodide content of less than 10 mol % is a photosensitive silver halide.

4. The photothermographic material according to claim 1, wherein the silver halide having a silver iodide content of less than 10 mol % has an average silver iodide content of 5 mol % or less.

5. The photothermographic material according to claim 1, wherein the silver halide having a silver iodide content of less than 10 mol % has an average silver iodide content of 2 mol % or less.

6. The photothermographic material according to claim 1, wherein the silver halide having a silver iodide content of 10 mol % or more has an average silver iodide content of 30 mol % or more.

7. The photothermographic material according to claim 1, wherein the silver halide having a silver iodide content of 10 mol % or more has an average silver iodide content of 60 mol % or more.

8. The photothermographic material according to claim 1, wherein the silver halide having a silver iodide content of 10 mol % or more has an average silver iodide content of 90 mol % or more.

9. The photothermographic material according to claim 1, wherein the silver halide having a silver iodide content of less than 10 mol % has an average silver iodide content of 5 mol % or less, and the silver halide having a silver iodide content of 10 mol % or more has an average silver iodide content of 30 mol % or more.

10. The photothermographic material according to claim 1, wherein the silver halide having a silver iodide content of less than 10 mol % has an average silver iodide content of 2 mol % or less, and the silver halide having a silver iodide content of 10 mol % or more has an average silver iodide content of 60 mol % or more.

11. The photothermographic material according to claim 1, wherein the silver halide having a silver iodide content of less than 10 mol % has a mean grain size of 0.12 μm or less.

12. The photothermographic material according to claim 1, wherein the silver halide having a silver iodide content of less than 10 mol % has a mean grain size of 0.01–0.1 μm.

13. The photothermographic material according to claim 1, wherein the silver halide having a silver iodide content of less than 10 mol % has a mean grain size of 0.02–0.08 μm.

14. The photothermographic material according to claim 1, wherein silver halide contained in the photothermographic material has a monodispersion degree of 40% or less.

15. The photothermographic material according to claim 1, wherein silver halide contained in the photothermographic material has a monodispersion degree of 30% or less.

16. The photothermographic material according to claim 1, wherein silver halide contained in the photothermographic material has a monodispersion degree of 0.1–25%.

17. The photothermographic material according to claim 1, which contains a silver halide with a gelatin.

18. The photothermographic material according to claim 17, wherein the gelatin has a molecular weight of 1,000–40,000.

19. The photothermographic material according to claim 1, which contains a high contrast agent.

20. The photothermographic material according to claim 1, wherein the silver halide having a silver iodide content of 10 mol % or more has a mean grain size of 0.01–0.1 μm.

21. The photothermographic material according to claim 1, wherein the silver halide having a silver iodide content of 10 mol % or more has a mean grain size of 0.02–0.08 μm.

* * * * *